US007070190B2

(12) United States Patent
Sadow

(10) Patent No.: US 7,070,190 B2
(45) Date of Patent: Jul. 4, 2006

(54) EXTENDABLE AND ANGULARLY ADJUSTABLE HANDLE FOR WHEELED LUGGAGE

(75) Inventor: Bernard D. Sadow, Chappaqua, NY (US)

(73) Assignee: Outrigger, Inc., Chappaqua, NY (US)

( * ) Notice: Subject to any disclaimer, the term of this patent is extended or adjusted under 35 U.S.C. 154(b) by 269 days.

(21) Appl. No.: 10/239,441

(22) PCT Filed: Nov. 2, 2001

(86) PCT No.: PCT/US01/47847

§ 371 (c)(1),
(2), (4) Date: Sep. 19, 2002

(87) PCT Pub. No.: WO02/35960

PCT Pub. Date: May 10, 2002

(65) Prior Publication Data

US 2003/0085540 A1 May 8, 2003

Related U.S. Application Data

(60) Provisional application No. 60/260,802, filed on Jan. 9, 2001, and provisional application No. 60/245,393, filed on Nov. 2, 2000.

(51) Int. Cl.
*B62K 15/00* (2006.01)

(52) U.S. Cl. ..... 280/37; 280/655; 16/110.1; 190/39

(58) Field of Classification Search ..... 280/37, 280/655, 655.1, 40, 38, 645, 654, 651, 638, 280/643, 647, 47.36, 47.371; 190/18 A, 39, 190/115; 16/110.1, 113.1, 114.1, 115
See application file for complete search history.

(56) References Cited

U.S. PATENT DOCUMENTS

| | | | | | |
|---|---|---|---|---|---|
| 3,620,546 | A | * | 11/1971 | Andersen | 280/40 |
| 5,178,521 | A | | 1/1993 | Liang et al. | 190/18 |
| 5,330,037 | A | * | 7/1994 | Wang | 190/18 A |
| 5,339,934 | A | | 8/1994 | Liang | 190/18 |
| 5,407,039 | A | * | 4/1995 | Alper et al. | 190/18 A |
| 5,484,046 | A | | 1/1996 | Alper et al. | 190/115 |
| 5,604,987 | A | * | 2/1997 | Cupp | 33/275 R |
| 5,630,521 | A | * | 5/1997 | Waddell et al. | 190/18 A |
| 5,689,854 | A | * | 11/1997 | Wang | 16/113.1 |
| 5,706,921 | A | * | 1/1998 | Wang | 190/115 |
| 5,713,441 | A | * | 2/1998 | Chen | 190/115 |
| 5,901,822 | A | * | 5/1999 | Tu | 190/115 |
| 5,951,406 | A | * | 9/1999 | Steane | 472/111 |
| 6,073,737 | A | * | 6/2000 | Kang | 190/18 A |
| 6,079,527 | A | * | 6/2000 | Kuo | 190/115 |
| 6,129,365 | A | | 10/2000 | Sadow | 280/47.26 |
| 6,186,522 | B1 | | 2/2001 | Weis | 280/37 |
| 6,230,656 | B1 | * | 5/2001 | Walach | 119/496 |
| 6,533,086 | B1 | * | 3/2003 | Waddell et al. | 190/18 A |

* cited by examiner

*Primary Examiner*—Hau Phan
(74) *Attorney, Agent, or Firm*—Abelman, Frayne & Schwab

(57) ABSTRACT

A wheeled luggage case that is tilted for towing is provided with a retractable and, optionally, telescoping handle (4) assembly that is withdrawn from the interior of the case to an extended vertical position at the intersection of the top and rear walls, from which it is angularly rotated by the user to a position that minimizes the vertical force that is required to support the hand grip to comfortably tow the luggage. Preferred angular displacements for a wide range of users and loads positioned in and on the luggage case have been found to be at about 17° and 35° from the vertical position.

23 Claims, 20 Drawing Sheets

FIG. 16
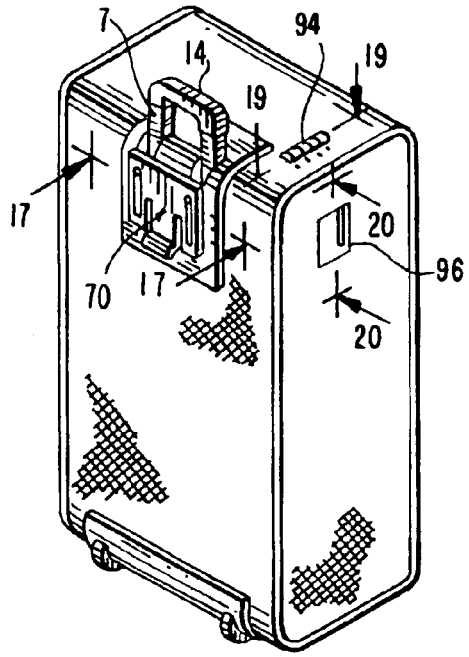
FIG. 17
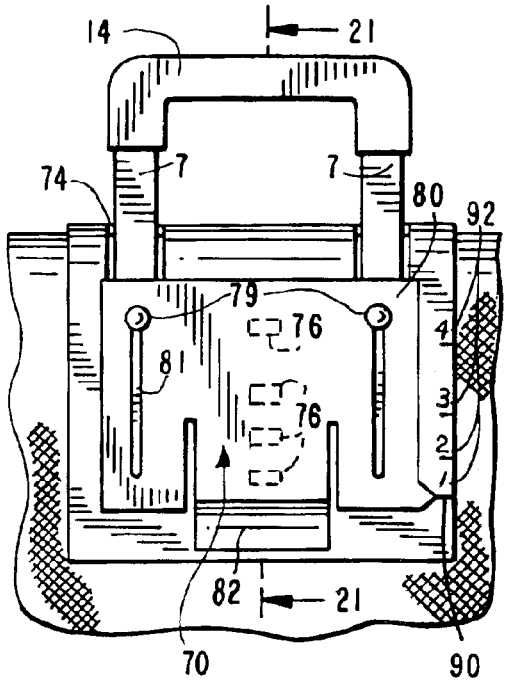
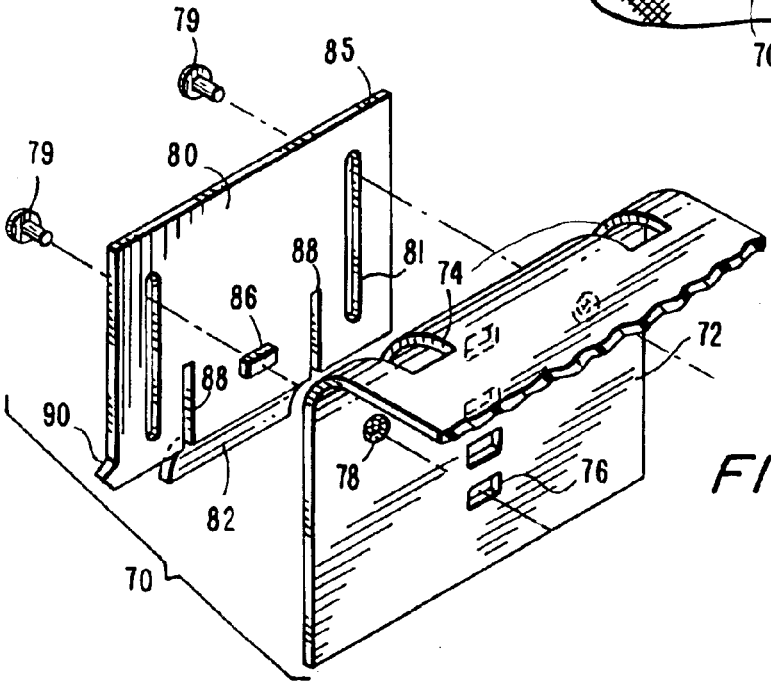
FIG. 18

FIG. 29
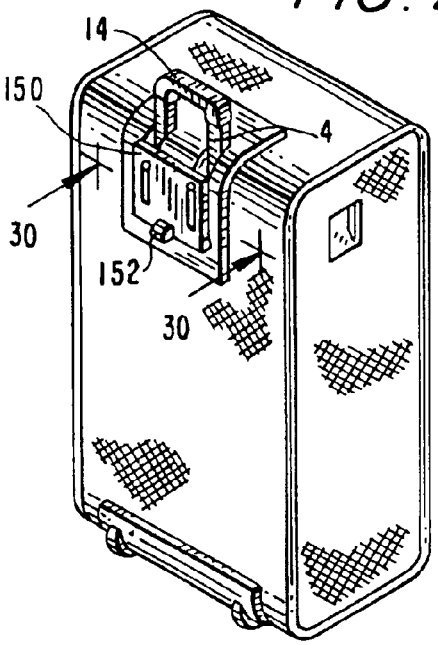
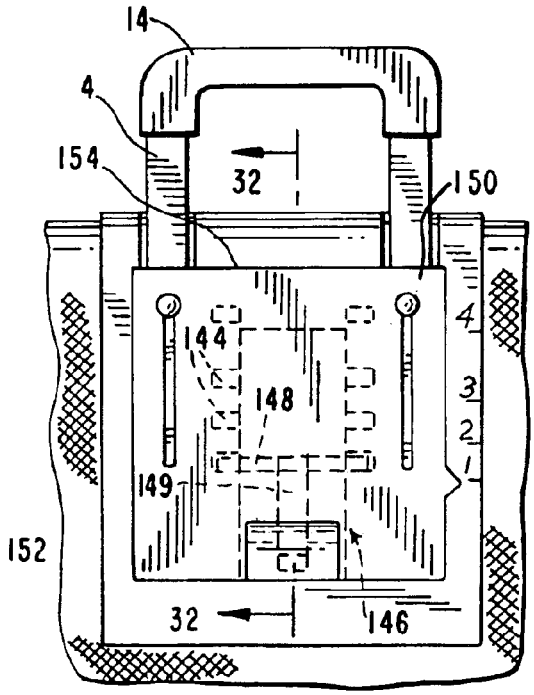
FIG. 30
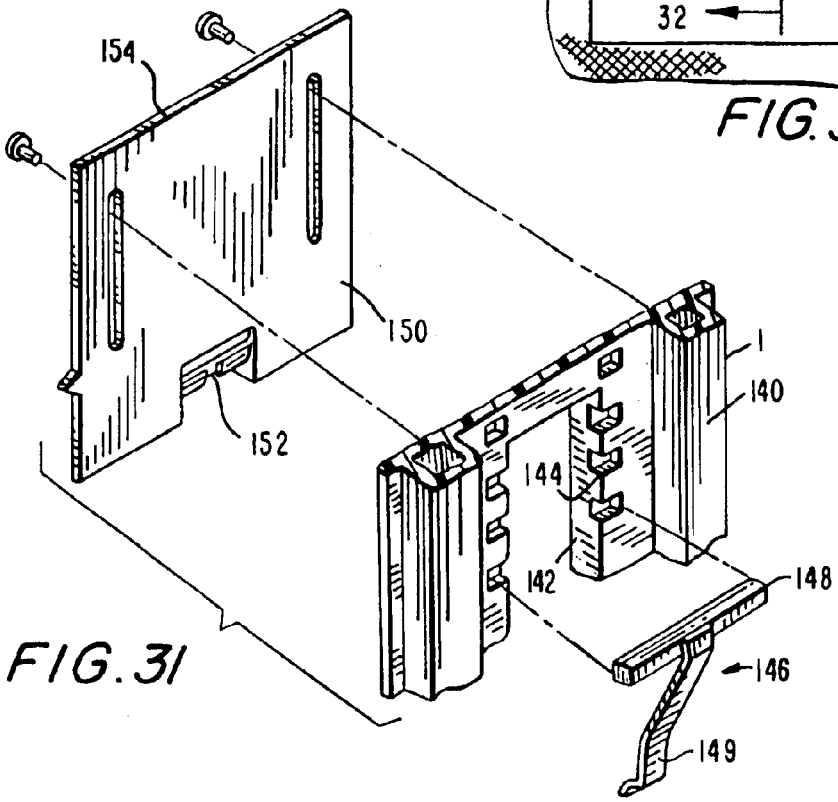
FIG. 31

FIG. 33
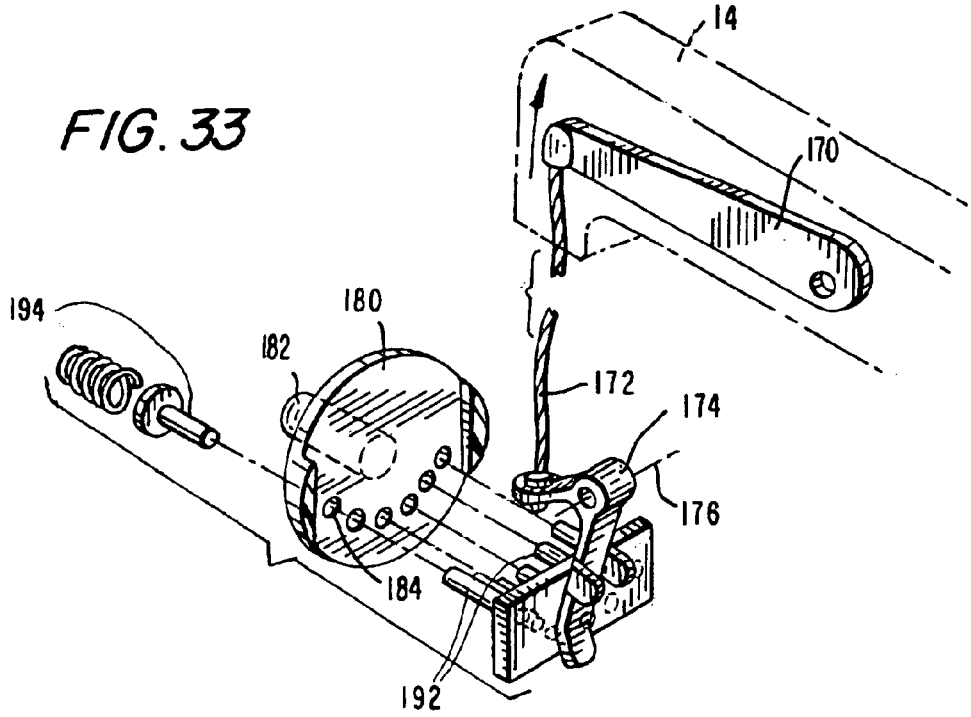
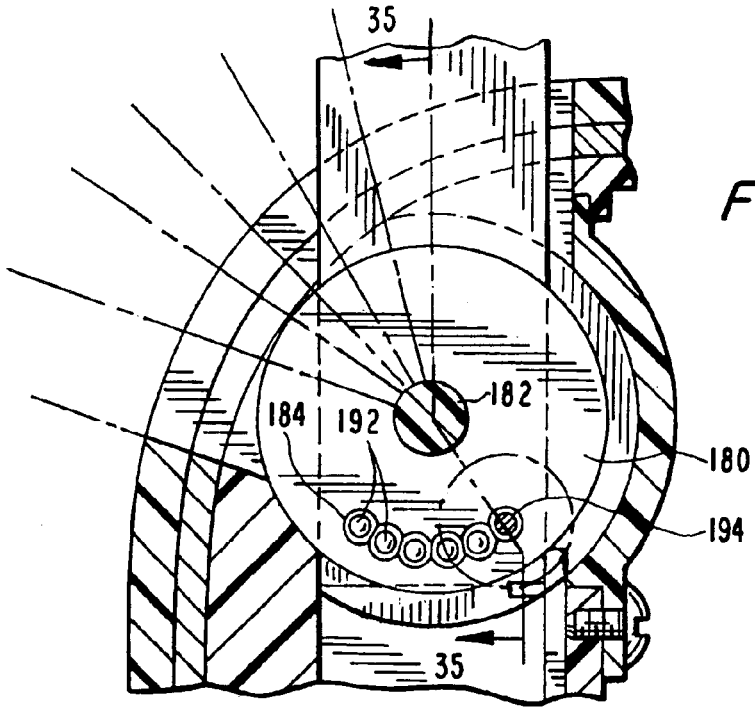
FIG. 34

EXTENDABLE AND ANGULARLY ADJUSTABLE HANDLE FOR WHEELED LUGGAGE

This application is a provisional application on Ser. No. 60/245,393, filed Nov. 2, 2000, and Ser. No. 60/260,802 filed Jan. 9, 2001.

FIELD OF THE INVENTION

This invention relates to a case or luggage having an extendable handle that may be wheeled in any one of the four directions parallel to the front, rear, and two side walls of the case or luggage and, in particular, to adjustable handles attached to such luggage to effect such wheeling.

DESCRIPTION OF THE RELATED ART

The entire disclosures of my U.S. Pat. Nos. 5,868,406 and 6,129,365 are hereby incorporated herein by reference. U.S. Pat. No. 5,868,406 generally discloses a handle inclined at an angle to the rear wall of the case when the handle was extended with respect to the case and when it was retracted with respect to the case. The handle in the retracted state was received in a housing mounted on the case for guiding and supporting the handle at the same angle fixed with respect to the rear wall of the case was the angle at which the housing for the handle was inclined. FIGS. 3, 4, 5 and 6 in the previously mentioned United States patents clearly show the physical arrangement of the inclined handle and the housing for supporting and guiding it with respect to the wheeled case.

It has been found that a fixed inclined handle is potentially subject to damage, i.e., bending or possibly even breaking if the case falls on the extended end of the handle, my U.S. Pat. No. 6,129,365 generally discloses several embodiments of a handle designed to resist such bending or breakage. The embodiments disclosed generally involve dividing the handle into two separate sections connected by means allowing rotation between the two sections, thus avoiding bending or breakage of the handle. Despite their obvious advantages, problems and disadvantages are left unalleviated by the improved disclosed in these two patents. First, since the guiding means for the handle is disposed at the same angle as the angle which the handle makes with the rear wall of the case, the length of the guiding means is limited by the angle which it makes with the rear wall of the case and the distance between the rear wall and the front wall of the case, if it is assumed that the guiding means is contained within the case. This may limit the length of the inclined handle which can be contained within the guiding means, and if such length is too short, use of a telescoping inclined handle may be necessary. Finally, the disclosure of a handle extending and retracting at a fixed angle necessitates the anti-breakage modifications of my U.S. Pat. No. 6,129,365, if danger of bending or breakage is to be avoided or minimized.

It has been recognized in the art that the actual or apparent effort expended by the user can be minimized if the extended handle exerts only a slight downward force on the user's hand during towing of the wheeled case. In U.S. Pat. No. 5,943,936, assigned to Samsonite Corp., a stowable handle is disclosed that can be withdrawn to an intermediate and fully extended position for towing. The portion of the handle legs adjacent the hand grip ar curved inwardly with a contour that overlies and conforms to the contour of the top of the luggage. By permitting the handle to be withdrawn to at least two different lengths, the height of the handle grip above the towing surface can be varied. According to the disclosure of the Samsonite '936 patent, this allows the user to optimize the position based upon the user's height/arm length as well as the weight and load distribution in the wheeled luggage and any attached auxiliary luggage. However, the extendable handle can be moved in only one direction, i.e., parallel to the back wall of the luggage. Depending upon the load and its distribution, the optimum position for the handle grip is very likely to be displaced only a few degrees from a vertical plane passing through the axis of the wheels. Regardless of the height of the handle above the towing surface, this will be a very uncomfortable position for all users during towing because the luggage will be impacting the back of the user's heels, or very nearly so, during a normal pace.

It is therefore an object of this invention to provide an extendable handle that is angularly adjustable, whereby the user can position the grip of the extended handle to optimize the user's comfort and facilitate towing, while also minimizing the vertical force that must be applied to the handle grip and thereby minimize exertion and fatigue.

Another object of the invention is to eliminate any special modifications to the handle to prevent bending or breakage of the handle should the case fall on the handle, with the handle extended.

Another object of the invention is to provide an extendable handle that can be withdrawn from a retracted storage position inside the case and adjusted angularly to a plurality of predetermined positions and/or any one position within the angular range, in order to optimize the towing position for the user by minimizing the force required to tow the case.

An object of the invention is to provide means for guiding and supporting the handle which can be equal in length to the height of the case.

A further object of the invention is to provide a handle that can be set at an angular position after being withdrawn from the stowed position adjacent the rear wall of the case.

A still further objection of the invention is to provide a handle which can be set in at least one predetermined angular position with respect to the rear wall of the case.

Another object of the invention to provide a handle which can be set an at angle with respect to the rear wall of the case, and which will rotate in response to the force of an impact if the case falls on the extended handle thereby avoiding bending or breaking, without the division of the handle into separate sections.

SUMMARY OF THE INVENTION

The invention comprises an inclined handle structure for a wheeled case or other wheeled luggage which stores the retracted handle in a position parallel to the rear wall of the case when the handle is retracted and provides for the adjustment of the extend handle to at least one position at an angle inclined to the rear wall of the case.

A first embodiment of the invention comprises an inclined handle structure mounted in the portion of a partially wheeled case furthest from a supporting surface in which the wheels rest. The inclined handle structure comprises two tubes mounted along the interior of the rear wall of the case. The legs of a U-shaped handle are mounted in the tubes so that the handle can be extended and retracted. The top element of the U-shaped handle spanning between the legs of the U-shaped handle grip is co-planar with the legs. When the U-shaped handle is held in its fixed angular position by means for locking the handle comprising a detent of the handle and a spring-loaded rod located on the outside of the luggage. The handle can be retracted back into the case by retracting the spring-loaded rod from contact with the detent.

A second embodiment of the invention dispenses with the spring-loading of the hinge, thereby allowing the user to manually rotate the handle to a desired or predetermined inclined position.

A third embodiment of the invention provides multiple angular positions for the handle by the placement of multiple detents or holes on the handle legs, and the handle legs are telescoping.

In order to assist the user in finding the optimum position of the luggage, including any auxiliary pieces of luggage or carrying cases that are attached tot he wheeled luggage, a tilt gauge is provided. The tilt gauge can conveniently be secured to a wall, for example, in an integral housing recessed a side wall adjoining the wall in which the handle is stowed. The tilt gauge can be in the form of a bubble gauge, either straight or curved, or a swing arm that is suspended by and rotates around a fixed pivot. The tilt gauge is also provided with indicia positioned along the path of movement of the bubble or the swing arm. corresponding indicia are provided on the luggage or the handle assembly for the purpose of setting the angular position of the handle in order to achieve the same angle of the luggage to the towing surface.

In order to prepare for towing, the user tilts the top of the luggage without causing it to roll on the wheels. This step is preferably done with extending the handle. When the luggage reaches the balanced position with the center of gravity over the axis of rotation of the wheel, there will be no tendency of the luggage to continue to tilt forward or to return to the vertical or rest position. When the luggage reaches this balanced position, the user notes the position of the tilt gauge indicator, being either the bubble or tip of the swing arm, relative to the stationary indicia. With this balanced point indicia in mind, the user then sets the angular position of the handle, thereby fixing the position of the handle grip to minimize the vertical force required to maintain the luggage during towing. This method and apparatus is adapted for use with luggage and cases of all sizes to assist the user in optimizing the angularly adjustable hand.

What I have found in the course of various experiments and tests with prototype constructions embodying my invention, is that a relatively narrow range of angular displacement, e.g., from the vertical, will allow a large majority of users to comfortably tow different sizes of wheeled luggage. This finding applies to a group of users whose height varied considerably from about five feet to well over six feet. This is a surprising finding, since it has long been assumed that the reasonably comfortable hand position for a tall user who was well above the mean or average male height of 5'-9", would be significantly different that a shorter use of a height well below the mean height. Thus, what I have discovered is that for users within a broad range of heights, that when the hand is extended rearwardly in the towing position, the vertical distance between the hand and the floor are substantially the same. From this determination, I have found that there are a limited range of angular displacement which creates a greatly improved, if not optimum center of gravity position that maximizes comfort and minimizes effort and strain during towing. This finding applies to luggage that is packed; luggage packed and supporting another piece on the top; or luggage packed and carrying an accessory on a strap that shifts the weight to the vertical wall opposite the extendable handle.

In an especially preferred embodiment of the invention, the extended handle is angularly rotatable to a first position that is displaced about 15° to 20° from the vertical; and to a second position that is about 32° to 38° from the vertical. In a most preferred embodiment, the first position is about 17° from the vertical and the second is about 35° from the vertical.

These and other benefits and advantages of the present invention will become apparent to those of ordinary skill in the art upon consideration of the attached drawings and the following description of the preferred embodiments, which are meant by way of illustration and example only, and are not to be construed as in any way limiting the invention disclosed and claimed herein.

BRIEF DESCRIPTION OF THE DRAWINGS

FIG. 16 is a top rear perspective view of a wheeled case illustrating another embodiment of the inventor;

FIG. 17 is an enlarged view of a portion of the case of FIG. 16 between view arrows 17—17;

FIG. 18 is an exploded top front perspective view partly in section, of the adjustable retaining and release mechanism of the case of FIG. 16;

FIG. 29 is a top rear perspective view of a wheeled case illustrating another embodiment of the invention;

FIG. 30 is an enlarged view of the adjustable retaining and release mechanism of the case of FIG. 29 taken at view arrows 30—30;

FIG. 31 is an exploded top front perspective detail view, partly in section, of the retaining mechanism of FIG. 30;

FIG. 33 is an exploded top right perspective view of one embodiment of an adjustable handle-positioning assembly for use in the invention;

FIG. 34 is a partial detail in cross-section showing the assembly of FIG. 33 installed in a case;

DESCRIPTION OF THE PREFERRED EMBODIMENTS

Figure 1:
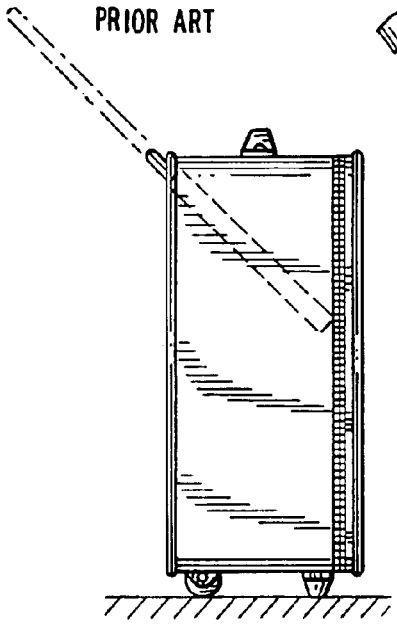
FIG. 1 PRIOR ART
FIG. 1 is a side elevation view of a case and an inclined handle in the retracted position of the prior art as disclosed in my U.S. Pat. No. 5,868,406, with the extended position of the inclined handle being shown in dotted lines.
Figure 2:
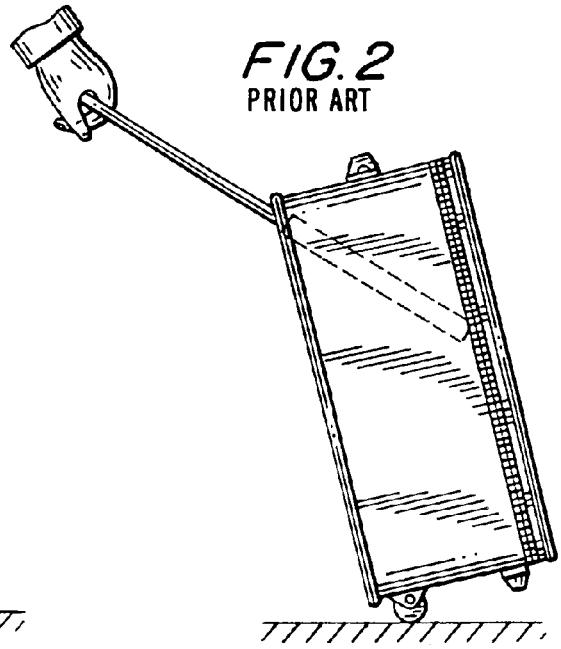
FIG. 2 PRIOR ART
FIG. 2 is a side elevation view of the case of FIG. 1 with inclined handle in the extended position.

With reference to FIGS. 1 and 2, there is illustrated a typical wheeled case of the prior art that has been provided with an extendable handle that is inclined at a fixed angle to the front wall of the luggage. In the stowed or retracted position, the arms of the extendable handle are retained in a pair of tubes 1 secured to the interior of the opposing side walls, the hand grip 14 being positioned proximate the junction of the top and back walls. As will be seen from FIG. 2, when extended for towing the handle assembly 4 is withdrawn from storage tubes 1 and the case or luggage is tipped over onto the wheels or rollers 2 for towing. As will be understood, the relative height of the user will determine the most convenient distance of the handle grip above the towing surface which in turn will determine the position of the centered gravity of the luggage relative to the access of rotation of the wheels. As will be understood by one of ordinary skill in the art, the optimum towing position is one in which the center of gravity of the luggage and its load is approximately in the plane of access of rotation of the wheels or roller 2. This has the effect of minimizing the vertical force that must be applied by the user's hand to keep the luggage in the most comfortable for towing, thereby reducing fatigue and minimizing the energy expended in moving the wheeled luggage and any auxiliary pieces that may have been attached to it.

Figure 3:
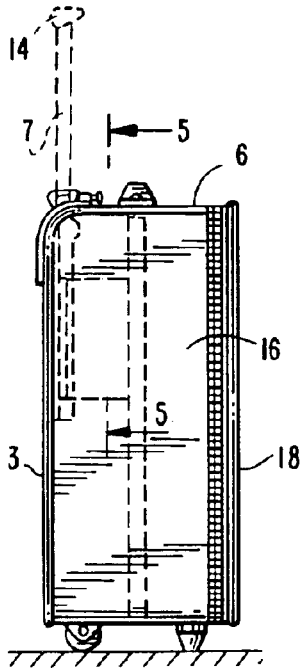
FIG. 3 is a side elevation view of a first embodiment of the invention showing a case in the vertical position with an inclined handle in the retracted position, and an extended vertical position of the inclined handle being shown in dotted lines.
Figure 4:
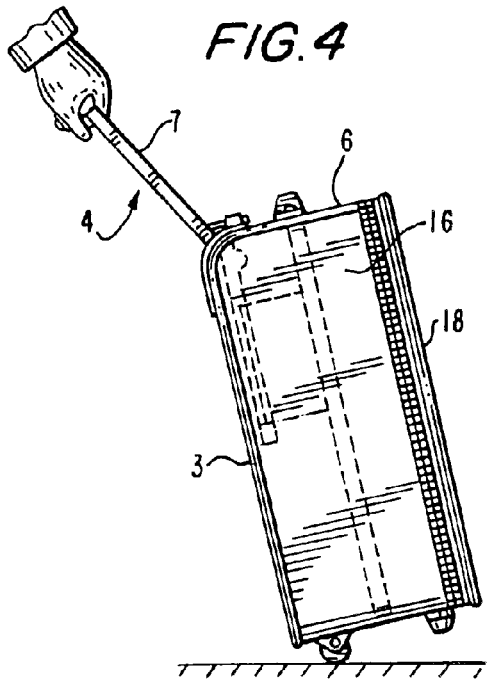
FIG. 4 is a side elevation view of the case of FIG. 3 showing the case at an angle to the vertical and an inclined handle in an extended and angled position.

With reference to FIGS. 3 and 4, there is illustrated a piece of luggage constructed in accordance with the invention in which the handle assembly 4 is stowed in guide tubes 1 mounted parallel and adjacent to the rear wall 3. When withdrawn from the stowed position, the handle assembly 4 can be angularly rotated around retaining means secured to the wall of the case to form an angle with the back wall of the case. As will be described in more detail below, the retaining means can be of a type that permits the handle assembly to be angularly rotated to any one of two or more predetermined fixed positions, or can permit the user to select any position within the range of motion of angular rotation prescribed by the structure.

Figure 5:
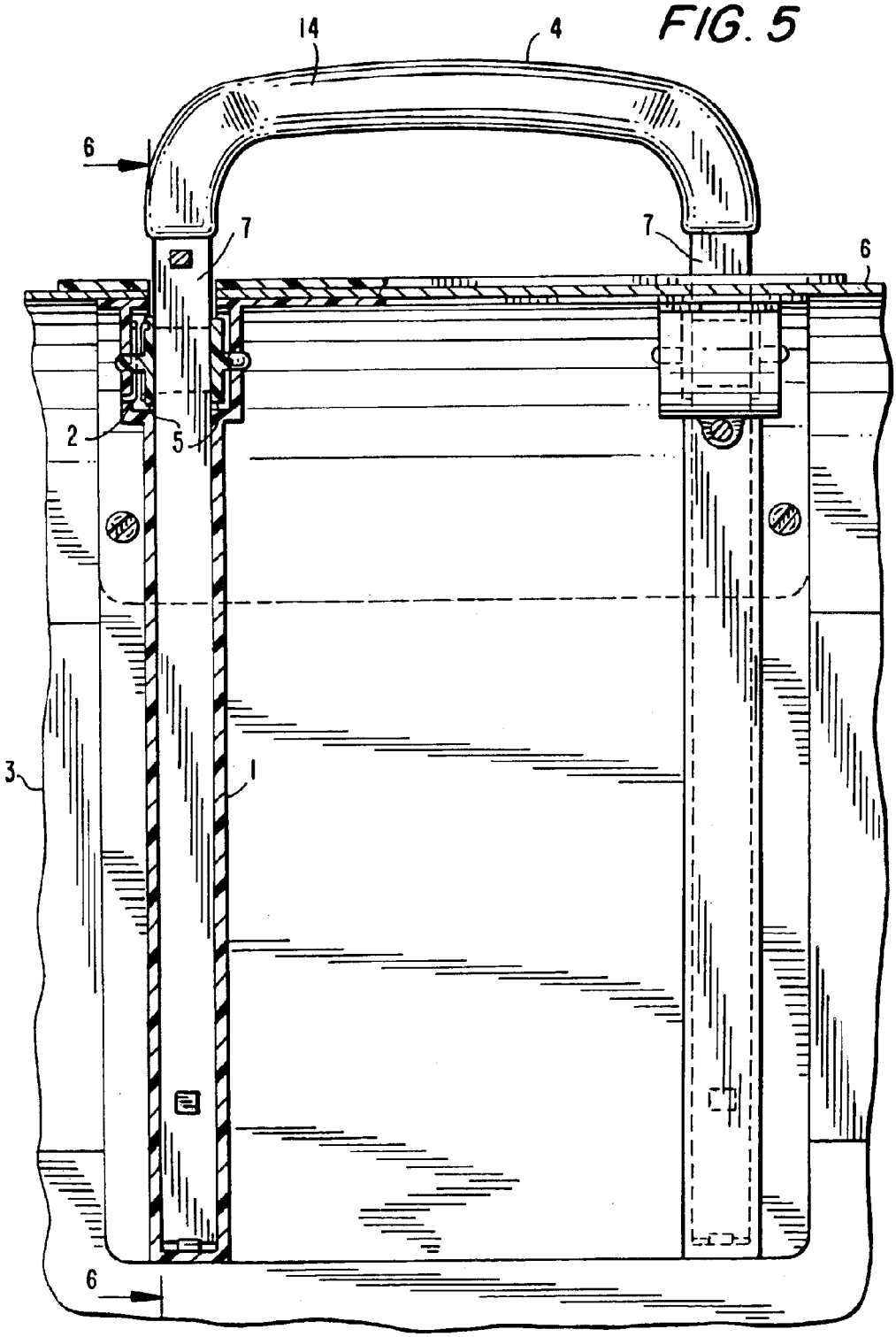
FIG. 5 is a partial cross-sectional view of the case of FIG. 3 showing the inclined handle in partial cross-section in a fully retracted position.
Figure 6:
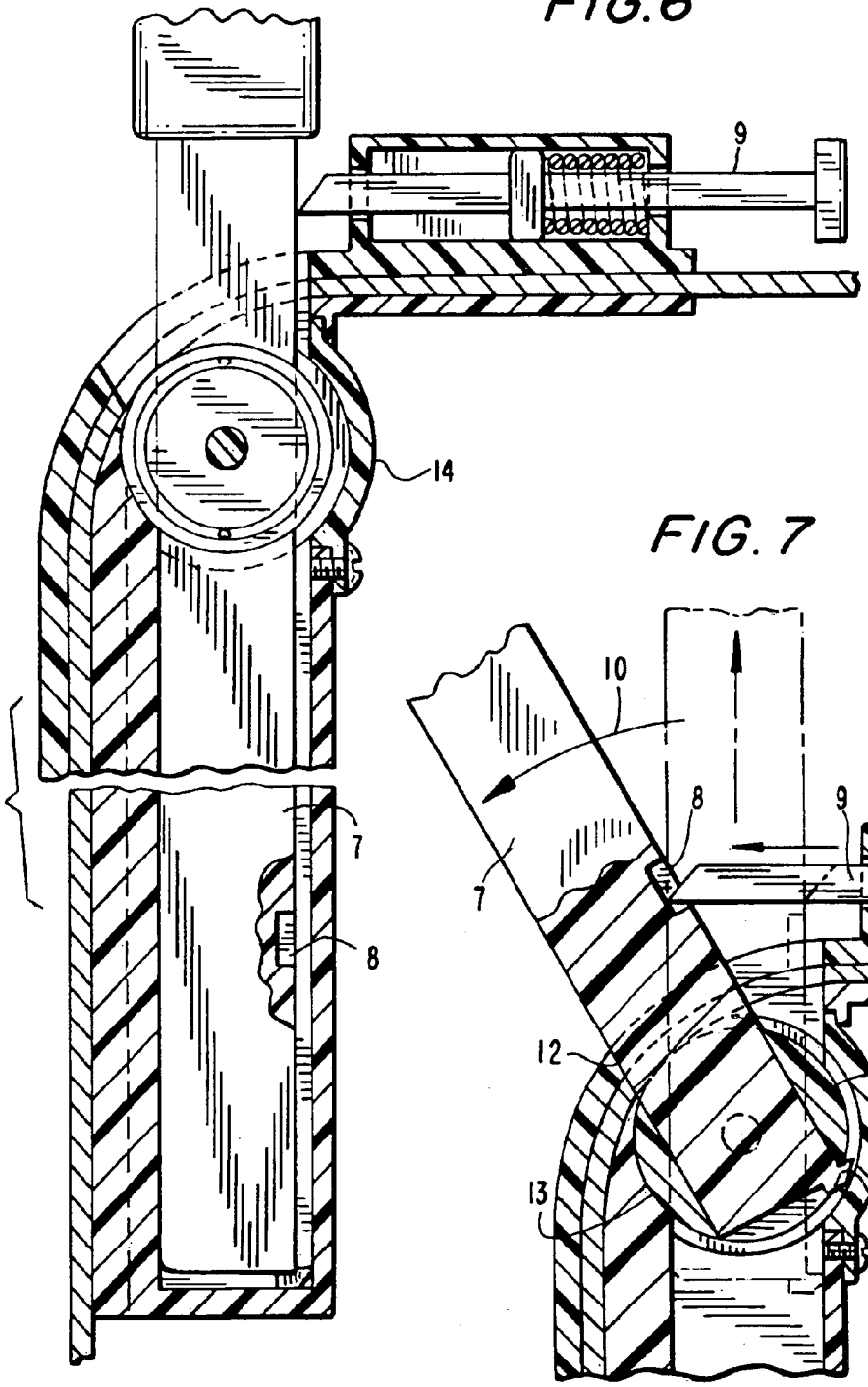
FIG. 6 is a cross-sectional view of FIG. 5 taken along section lines 6—6.
Figure 7:
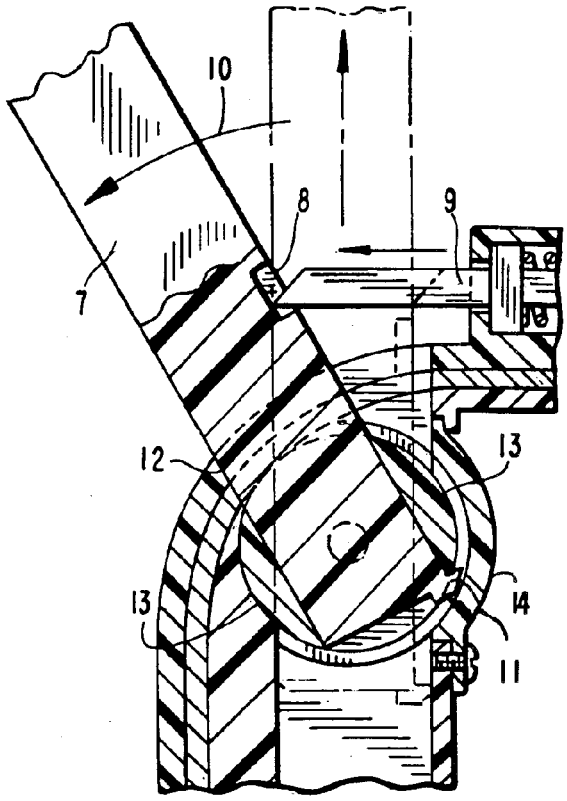
FIG. 7 is a partial detail of FIG. 6 showing the end of the inclined handle in the fully extended and tilted position, with dotted lines indicating the position of the handle while being extended.
Figure 8:
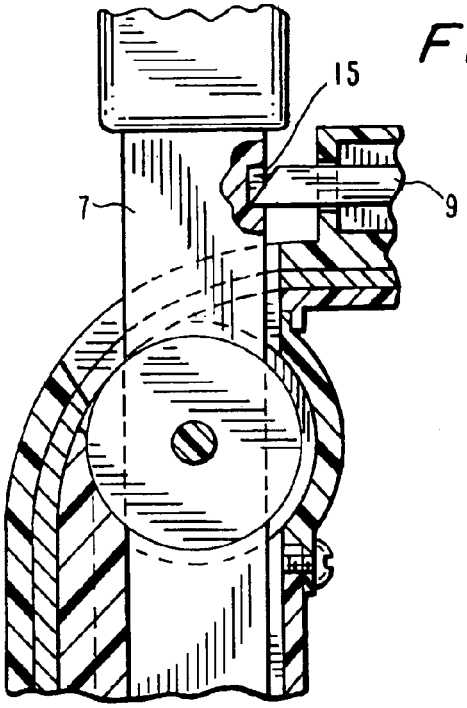
FIG. 8 is a partial detail of a second embodiment of the invention in partial cross-section, showing a portion of the top of the case and a portion of the top of the inclined handle in the fully retracted position.
Figure 9:
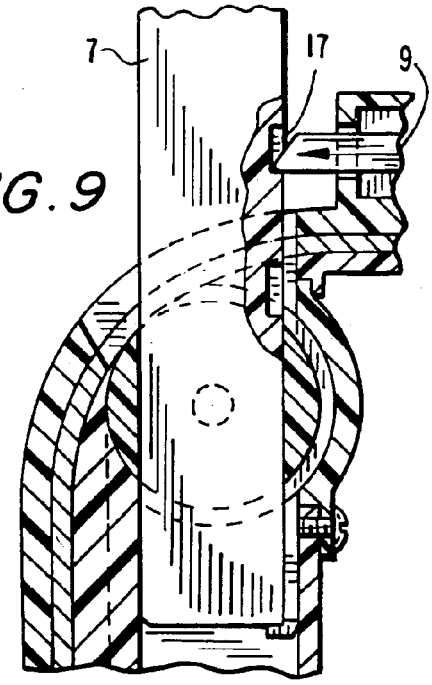
FIG. 9 is partial detail of a second embodiment of the invention similar to FIG. 8, but the handle is shown in the partially extended position.
Figure 10:
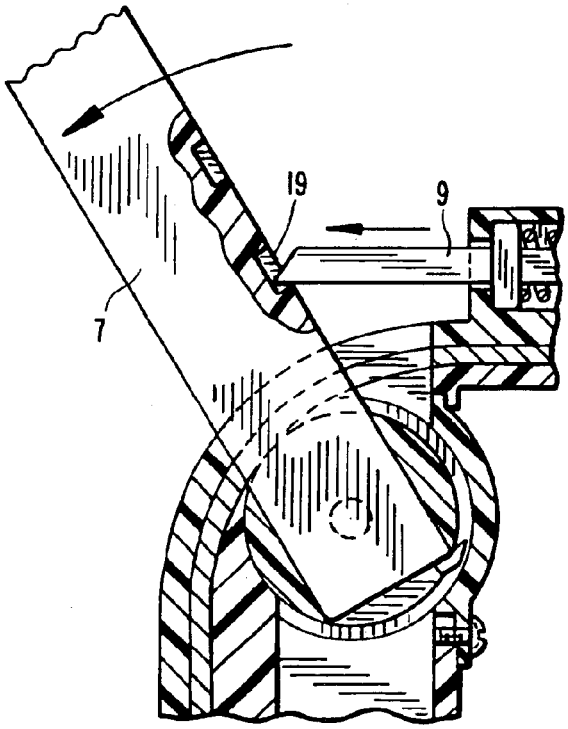
FIG. 10 is partial detail of a second embodiment of the invention similar to FIG. 8, but FIG. 10 shows the inclined handle in the fully extended and tilted position.

With reference to FIG. 5, it will be seen that the inclined handle 4 can be of a U-shaped configuration fitting into guide tubes 1 mounted on the interior rear wall 3 of a case or piece of luggage 10. In order to ensure that the inclined handle 4 assumes the inclined position with respect to the rear wall of the case when the handle is fully extended, rotating discs 5 are mounted at the top of each of the guide tubes 1 adjacent to the top wall 6 of the case. Each pair of rotating discs are biased with a spring 2 in such a way that the rotating discs rotate the handle to the inclined position when it is fully extended. As can be seen in FIGS. 5 and 6, the rotating discs 5 are prevented from rotating the legs 7 as long as the legs 7 are within the region of the guide tubes 1 where the guide tubes 1 have straight walls. However, as soon as the legs enter the upper region of the guide tubes 1 where a curved wall 14 exists, the rotating discs 5 rotate the end of the legs 7 as shown in FIG. 7.

At least one leg 7 of the inclined handle 4 is provided with a notch 8 towards the bottom of the leg 7. When the leg 7 is fully extended and rotated about the rotating disc 5, a spring biased push pin 9 which is held in a retracted position by contact with the leg 7 of the handle as the handle is being extended, will expand to engage the notch 8 thereby locking the handle in its fully tilted position and preventing the handle from rotating back towards the vertical.

Further angular motion of the handle beyond the full angle 10 of tilt is limited by the edge 12 of the wall of the case. A limit stop 11 prevents further extension of the inclined handle by contact with intermediate section 13 between the rotating discs 5, two intermediate sections 13 between the rotating discs 5 being on opposite sides of the leg 7 of the handle. To retract the handle into the case, the user simply pulls the push pin 9 out of contact with the notch 8 and manually rotates the handle 4 into a vertical position and pushes it back into the case.

Although the legs 7 of the handle are shown as square solid sections, solid circular or rectangular sections, or square, rectangular, or circular tubular sections may, well, be used for those legs. In addition, although only one push pin 9 is shown for one leg 7, another push pin 9 may be provided for the other leg 7 to provide additional means for locking the handle in its operational angle so long as the other leg 7 is provided with a similar notch to the notch 8. Finally, although a U-shaped telescoping handle is shown, a single-legged handle may be used. However, for a single-legged handle, a square or rectangular cross-sectional leg of either a solid or tubular cross-section would be the simplest choice of legs to prevent rotation of the leg in its guiding means. Such rotation could occur with legs of circular solid or tubular cross-section, interfering with the proper positioning of any notch with respect to a push pin.

As will also be understood by one of ordinary skill in this art, the handle assembly 4 can be constructed of a single rod or tube and with a "T" or "L" handgrip at the end. A U-shaped handle with a pair of legs is preferred as providing maximum rigidity to the structure.

A second embodiment of the invention differs from the first embodiment in that spring-biasing of the rotating discs is eliminated. This may be less convenient for the user since the user can manually rotate the handle to an inclined position, instead of relying on spring-biasing of the rotating discs to accomplish this rotation. In addition, a notch 15 has been added near the top of at least one leg to lock the handle down in the retracted position by means of the push pin. Furthermore, an additional notch 17 near the bottom of the at least one leg is shown to allow locking of the handle in a straight position prior to full extension and rotation of the handle. This is an optional feature that the user may desire in order to use the handle in the conventional straight position and could also be added to the first embodiment. An additional notch 19 adjacent to the bottom of the at least one leg, similar to the notch 8 shown in the first embodiment, locks the leg against the rotation back into the straight position through the expansion of the push pin into contact with that notch. As before, the edge of the case prevents the inclined handle from further rotation to a greater angle than the maximum otherwise provided. Finally, a limit stop similar to the one shown in the first embodiment prevents the handle from being pulled straight out of the case.

As was described in detail above, the preferred fixed positions of angular displacement are at about 17° and 35° from the vertical plane defined by the rear or back wall of the luggage case. In a typical construction of the apparatus, the handle assembly 4 is pulled vertically to withdraw it from the retaining tubes 1 that are secured to the rear wall on the interior of the case. After being fully withdrawn from the luggage, the handle assembly can be angularly rotated about rotational retaining means 18 to the first or second stop positions at about 17° and 35°, respectively.

As will be understood by those of ordinary skill in the art, the construction and assembly of the rotational retaining means 18, the handle assembly 4, and the other related elements can be simplified for luggage having two stops for towing positions for towing. In the embodiments which are described herein, it will be understood that modifications can be made to conform to the described two-position embodiment of the rotated handle.

Figure 12:
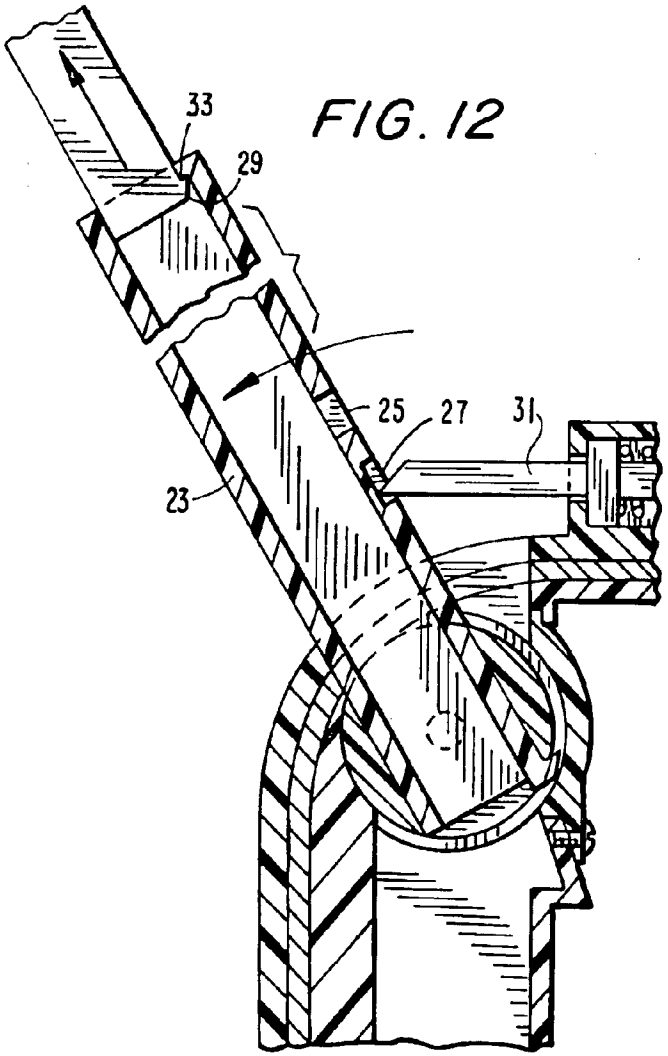
FIG. 12 is a partial detail of a third embodiment of the invention in cross-section, showing a portion of the top of the case along with a portion of the inclined handle in the fully extended and tilted position.
Figure 11:
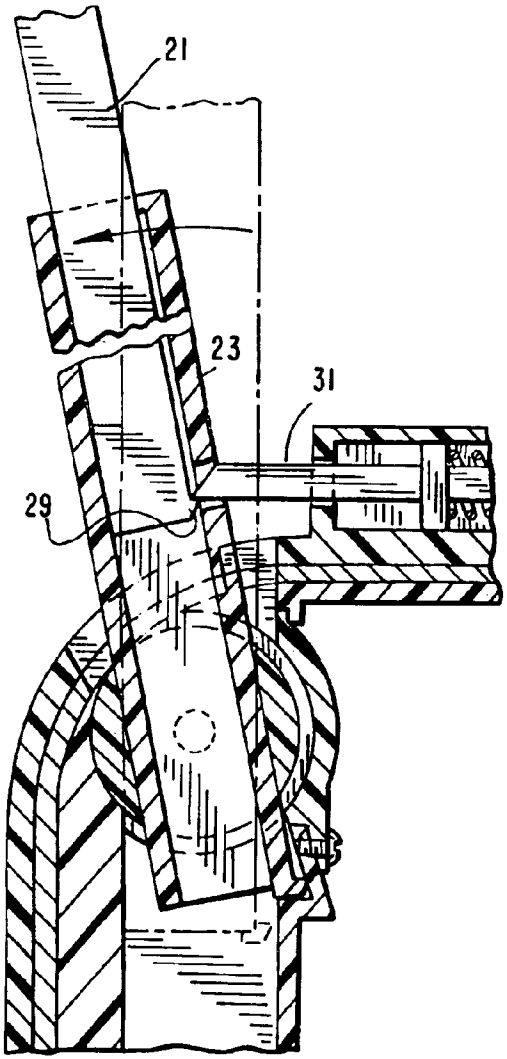
FIG. 11 is a partial detail of a third embodiment of the invention in cross-section, showing a portion of the top of the case along with a portion of the inclined handle in the fully extended and tilted position.

A third embodiment of the invention comprises a telescoping handle with at least two sections, having at least an inner telescoping section 21 telescoping out from within the outer section 23. This embodiment also allows for multiple angular positions of use, the handle being held in place in such multiple positions by multiple holes or notches 25, 27 and a push pin. The third embodiment also may eliminate any spring-biasing of the rotating discs, as in the second embodiment, since such spring-biasing would perhaps cause the handle to "slip over" intermediate notches as the handle automatically rotates outward. It should be noted that in the first angular position, shown in FIG. 11, the hole 25, penetrating the tubular outer section 23, allows the push pin 31 to catch a limit stop 29 on the end of the inner telescoping section 21, and thereby allowing inner telescoping section 21 to be pulled further out, while increasing the angle of tilt. The maximum angle of tilt and extension of the handle is shown in FIG. 12. FIG. 12 shows the push pin in notch 27 and the limit stop 29 at a mating projection 33 on the inside end of the outer section 23.

Figure 15:
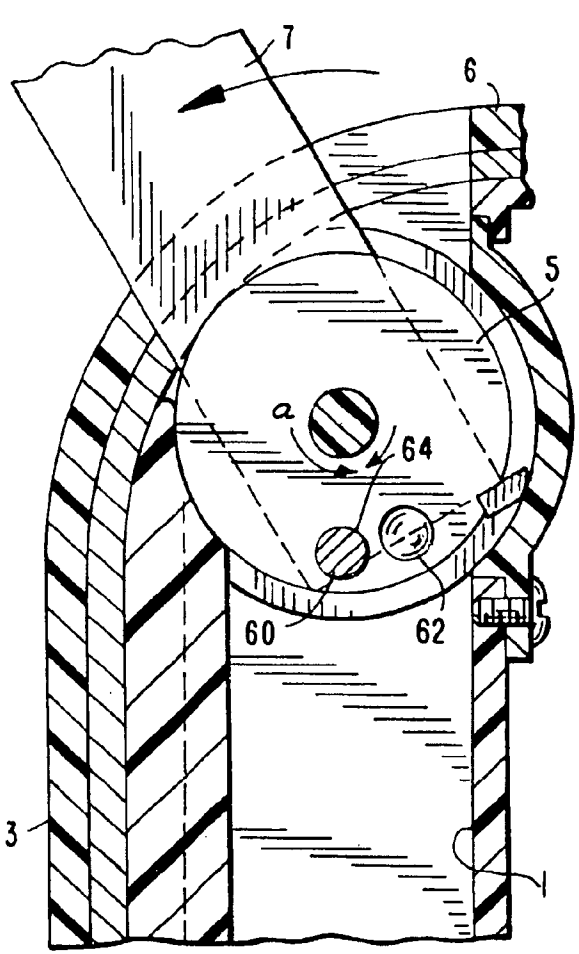
FIG. 15 is a view similar to FIG. 13 with the handle in a tilted position with respect to the wall of the case.
Figure 14:
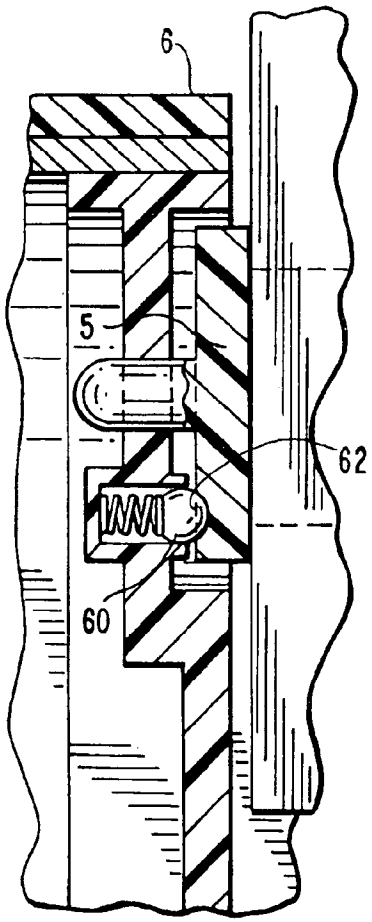
FIG. 14 is a cross-sectional view taken along lines 14—14 of FIG. 13.
Figure 13:
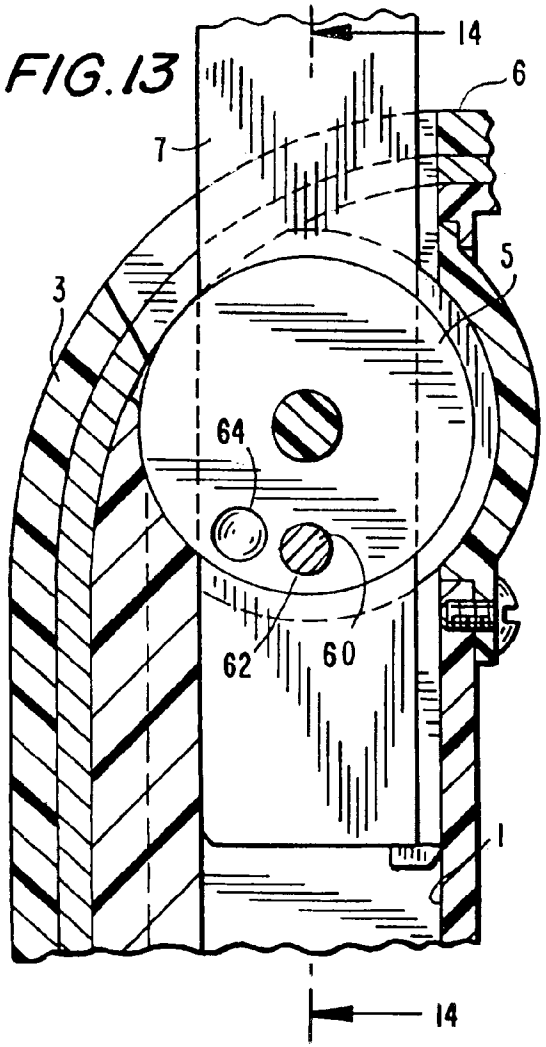
FIG. 13 is a partial detail of another embodiment of the invention in cross-section showing the rotational locking mechanism and a portion of the handle in the fully-extended position before tilting.

A further preferred embodiment of the adjustable positioning and impact release assembly is shown in FIGS. 13–15, in which the disk 5 is provided with a pair of adjacent apertures 62, 64 separated an angular displacement "a". A spring-biased ball catch is fixed to engage the first aperture 62 when the handle is in the extended vertical position parallel to the wall adjacent the storage guide housing 1 as shown in FIG. 13. As shown in the cross-sectional view of FIG. 14, the ball is received in a channel extending from the first aperture 62 to second aperture 64. When the handle is moved to the maximum angular displacement with respect to its initial vertical position, the ball catch is positioned in second aperture 64 and provides a sufficiently secure engagement to maintain the handle 7 at this predetermined angle in resistance to those forces that are anticipated during normal towing of the case, including movement of the case across rough paving, over curbs and up and down staircases. However, should the case inadvertently be allowed to fall over on the extended tilted handle, the ball catch will be dislodged by the force of impact and cause the handle to rotate back in the direction of the rear wall of the case, thereby avoiding any bending or other damage to the handle assembly or the angular retaining means.

Figures 19, 20, 21, 22:
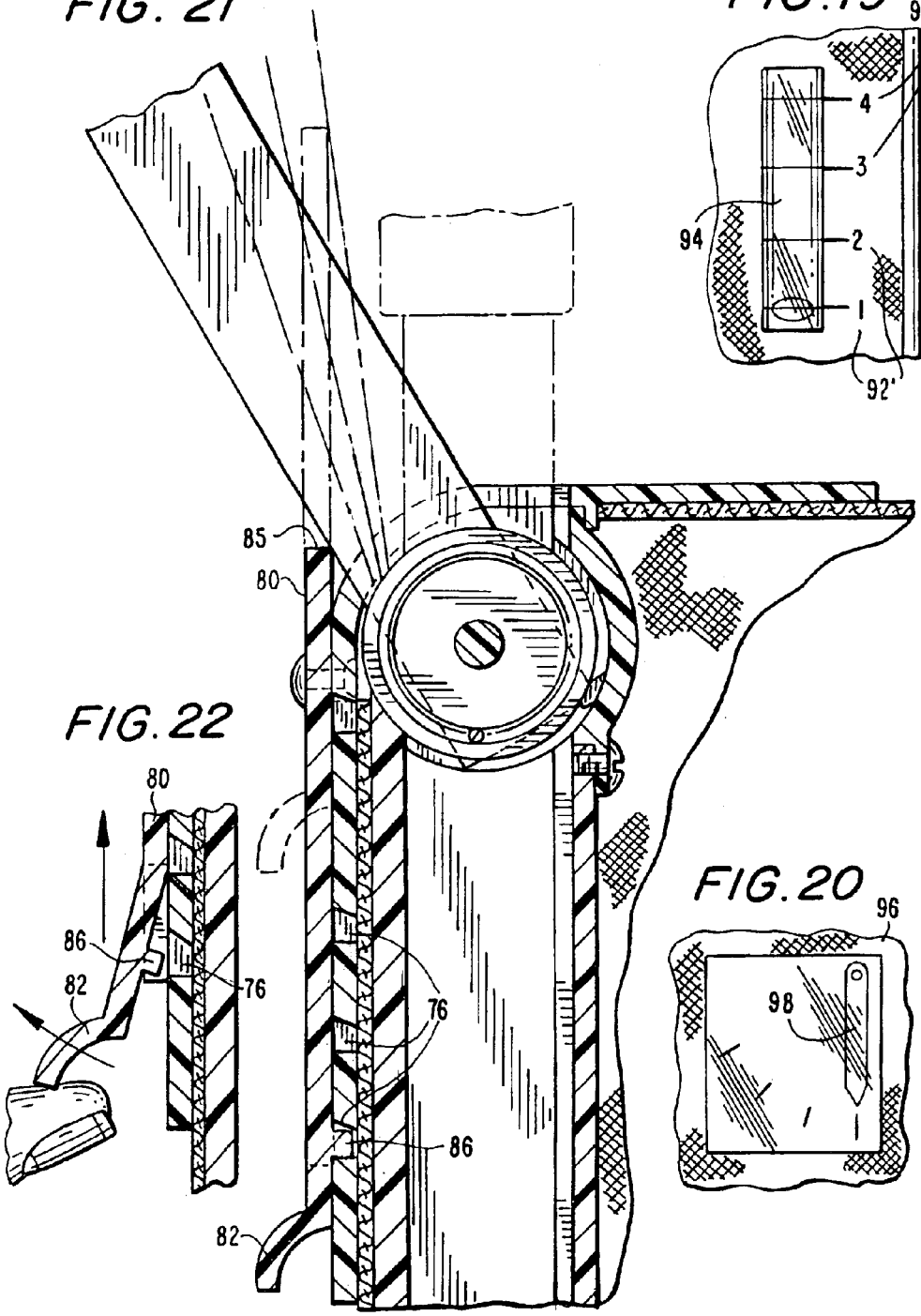
FIG. 19 is an enlarged view of the portion of the case of FIG. 16 between view arrows 19—19.
FIG. 20 is an enlarged view of the case of FIG. 16 between view arrows 20.
FIG. 21 is a cross-sectioned view, partly in phantom, taken along lines 21—21 of FIG. 17.
FIG. 22 is a detailed cross-sectional view illustrating to manual operation of the release mechanism of FIG. 21.
Figure 23:
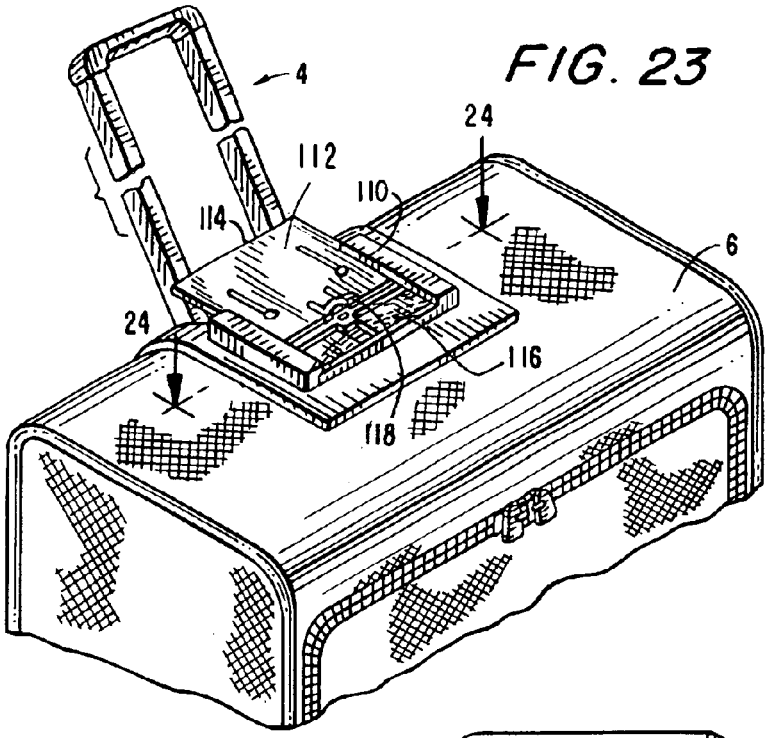
FIG. 23 is a top front perspective view of a portion of a wheeled case illustrating another embodiment of the invention in which an intermediate section of the handle has been eliminated.
Figure 24:
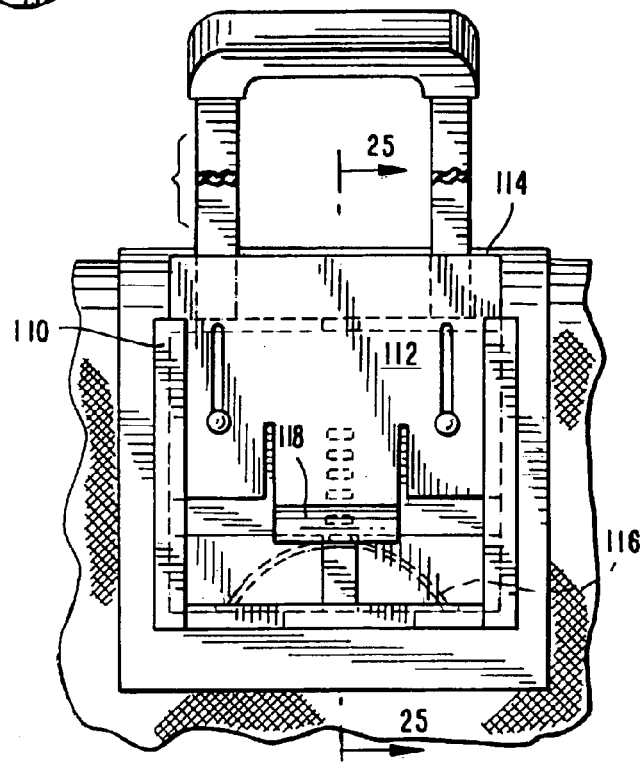
FIG. 24 is top plan view of the release mechanism of FIG. 23 between view arrows 24—24.
Figure 25:
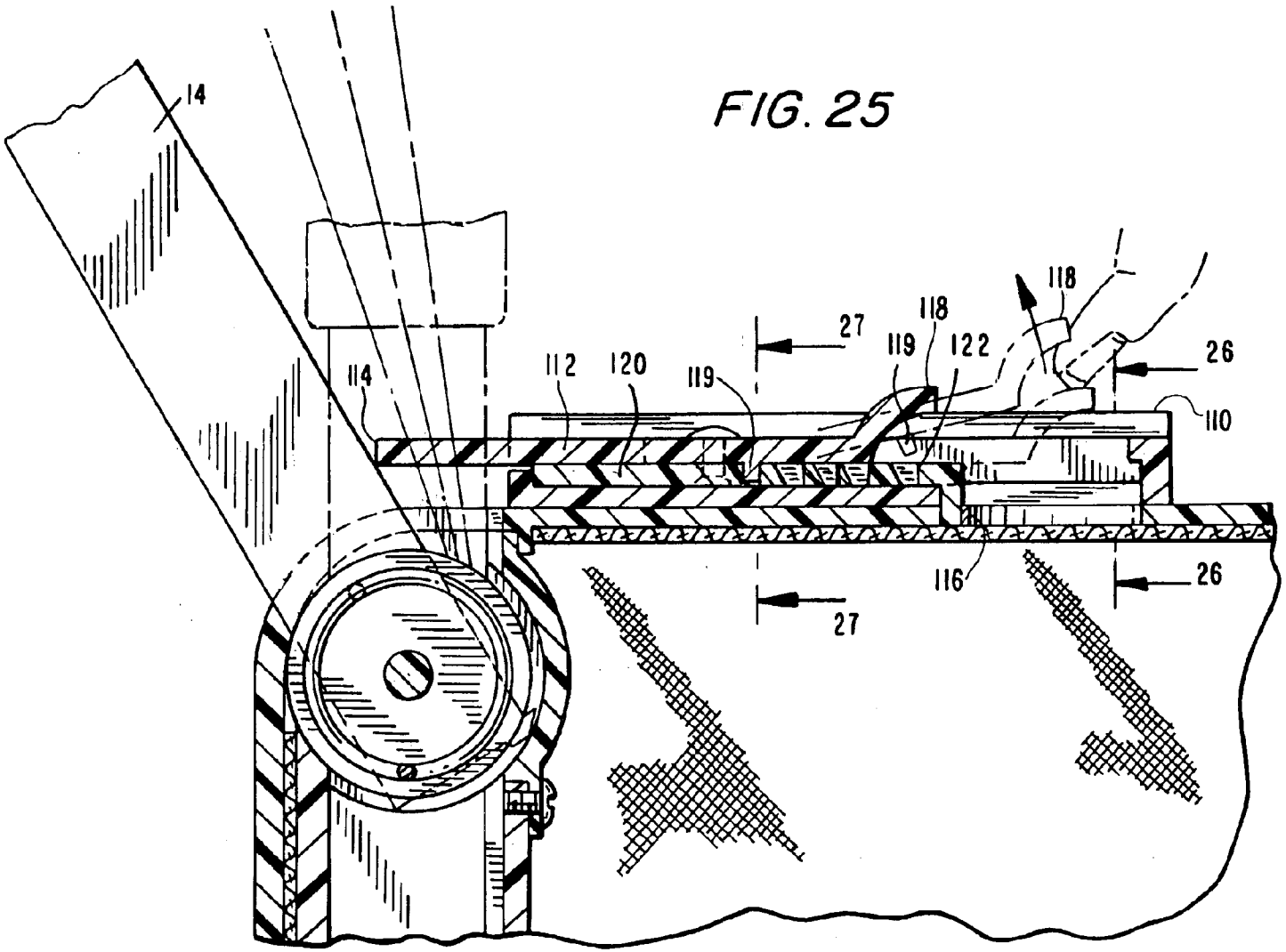
FIG. 25 is a cross-sectional view, partly in phantom, taken along lines 25—25 in FIG. 24 and illustrating the manual adjustment of angle of the handle.
Figure 26:
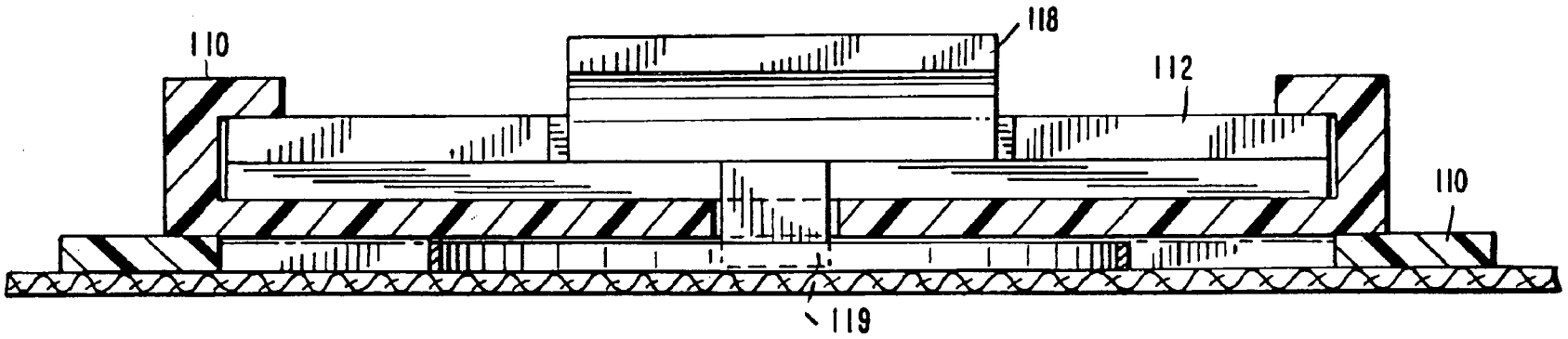
FIG. 26 is a cross-sectional view taken along the lines 26—26 on FIG. 25.
Figure 27:
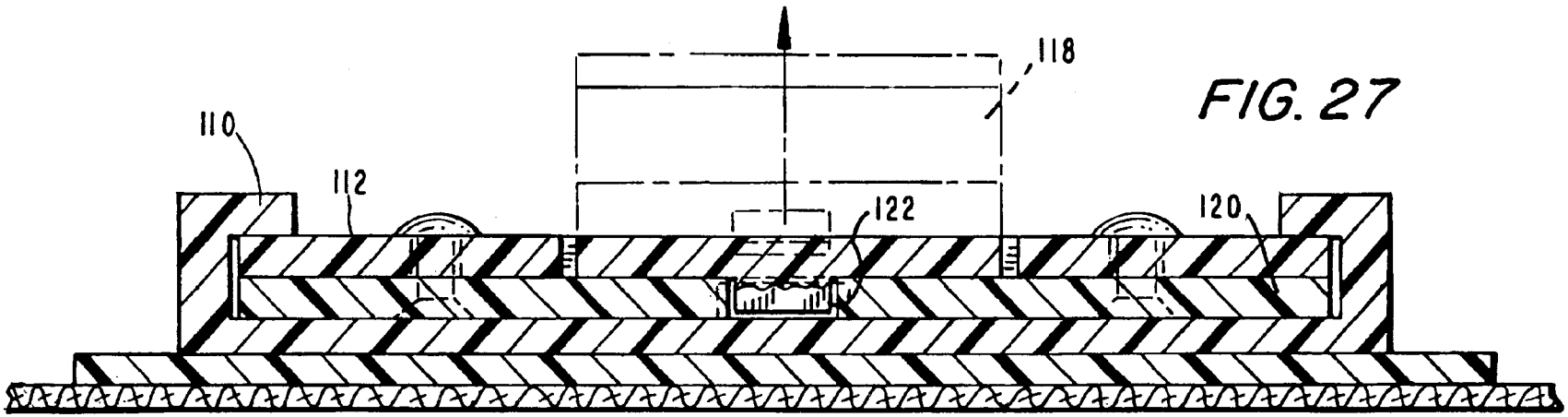
FIG. 27 is a cross-sectional view taken along the lines 27—27 in FIG. 25.
Figure 28:
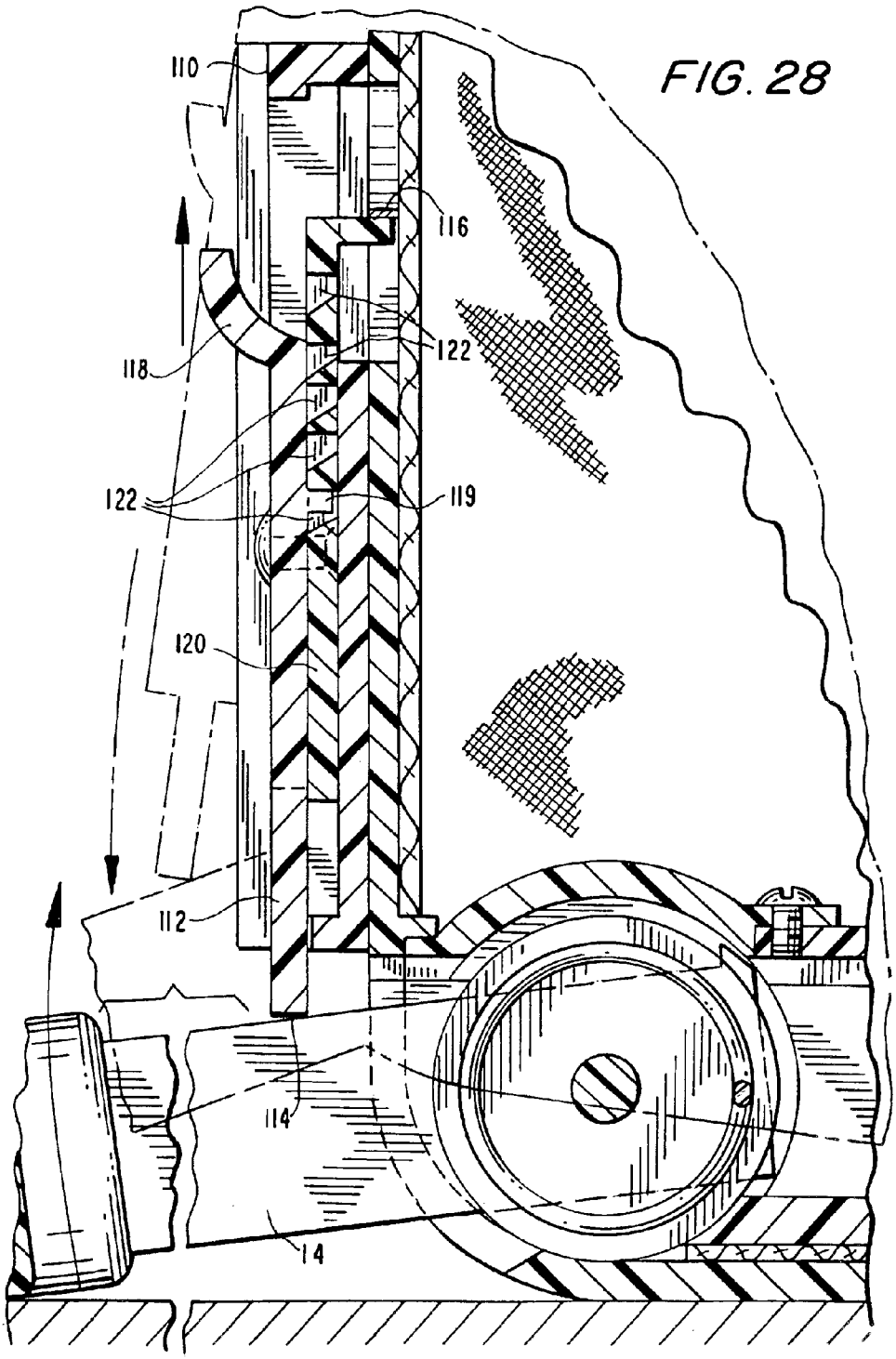
FIG. 28 is a cross-sectional view similar to FIG. 25, partly in phantom, illustrating the movement of the release mechanism upon an impact force applied to the extended handle.
Figure 32:
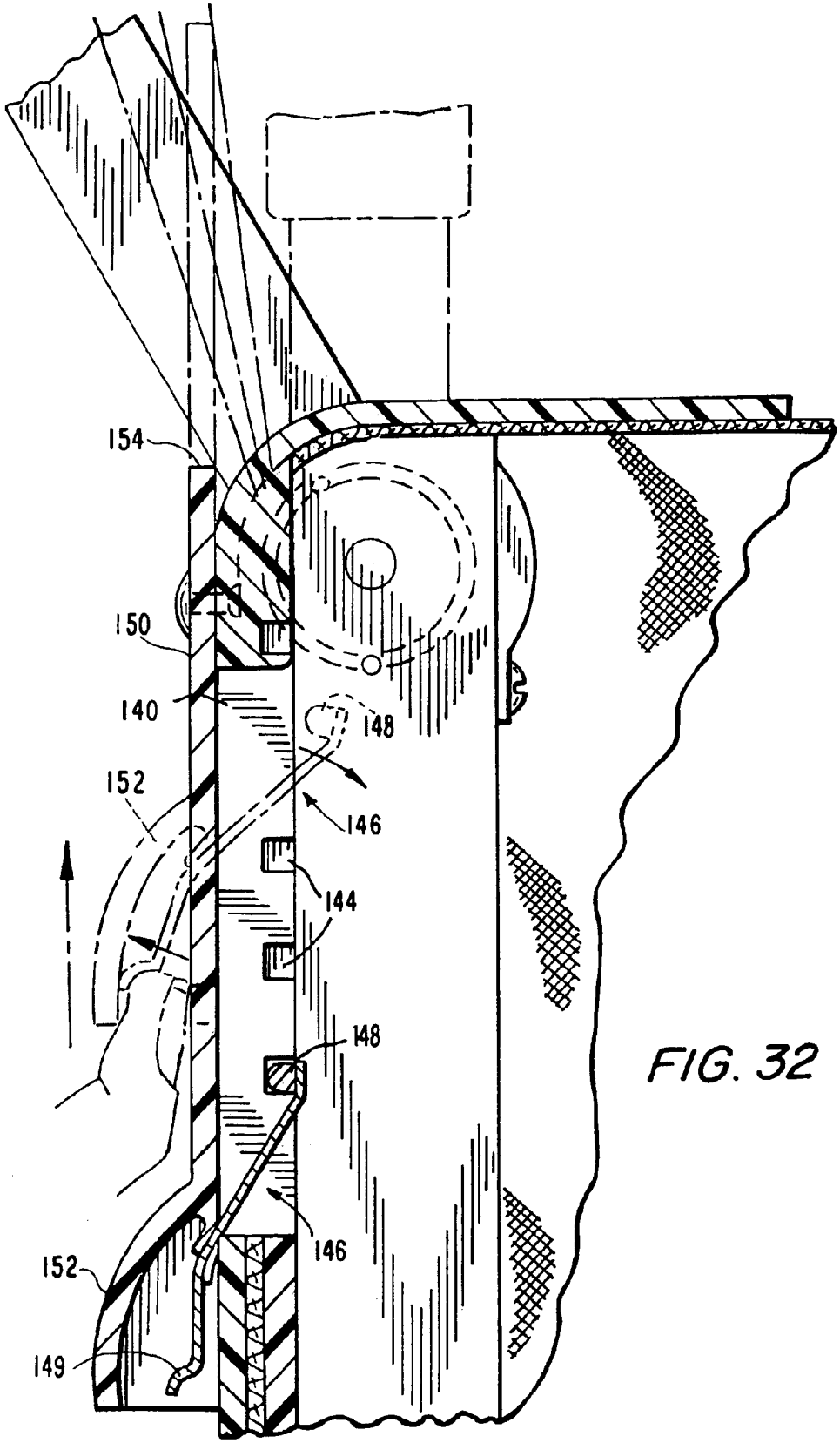
FIG. 32 is a cross-sectional view of the retaining mechanism of FIG. 30, partly in phantom, with the handle in the extended position and illustrating the manual adjustment.
Figure 36:
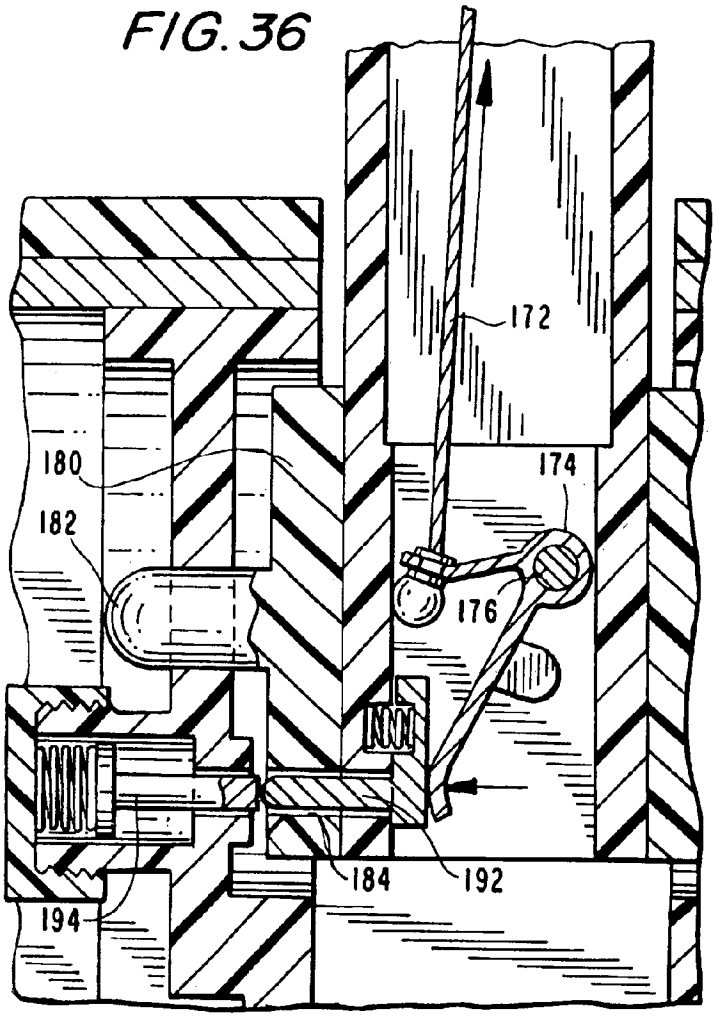
FIG. 36 is a cross-sectional view similar to FIG. 35 illustrating the activation of the release mechanism of the handle-positioning assembly.
Figure 35:
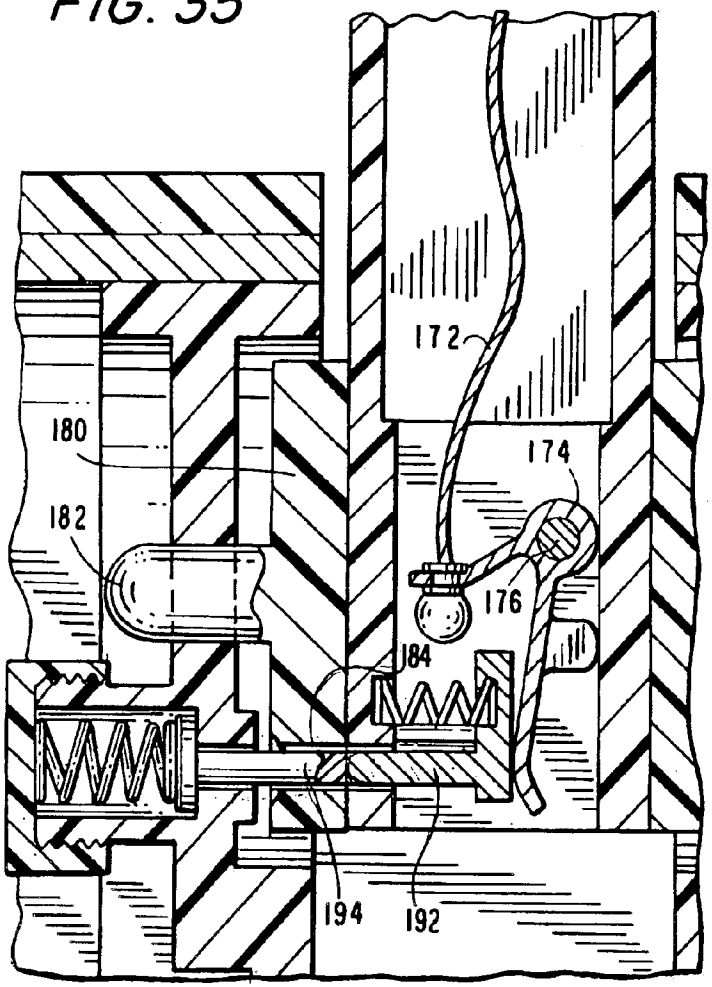
FIG. 35 is a cross-sectional view taken along lines 35—35 of FIG. 34.
Figure 37:
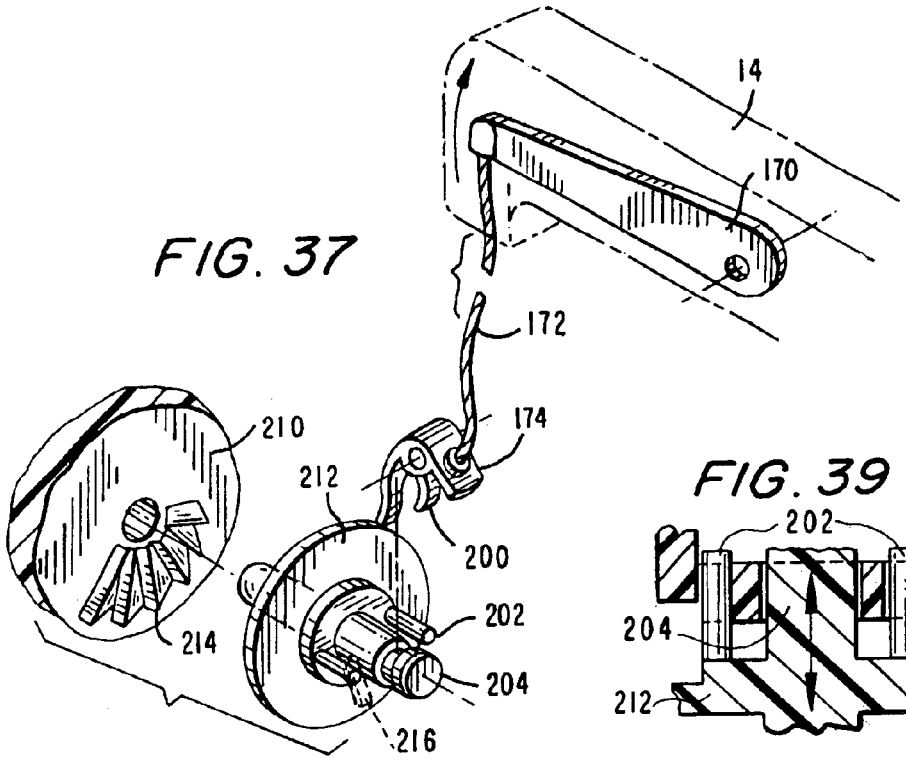
FIG. 37 is an exploded top right perspective view of another embodiment of an adjustable handle positioning assembly for use in the invention.
Figure 39:
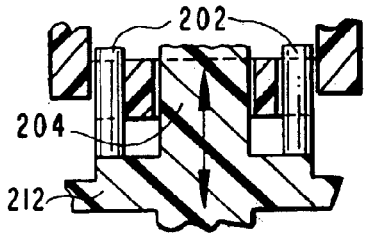
FIG. 39 is a cross-sectional view taken along lines 39—39 in FIG. 38.
Figure 40:
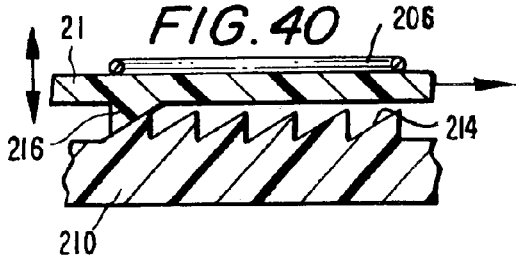
FIG. 40 is an angular cross-sectional view taken along an arc extending between radian lines 40—40 in FIG. 38.
Figure 38:
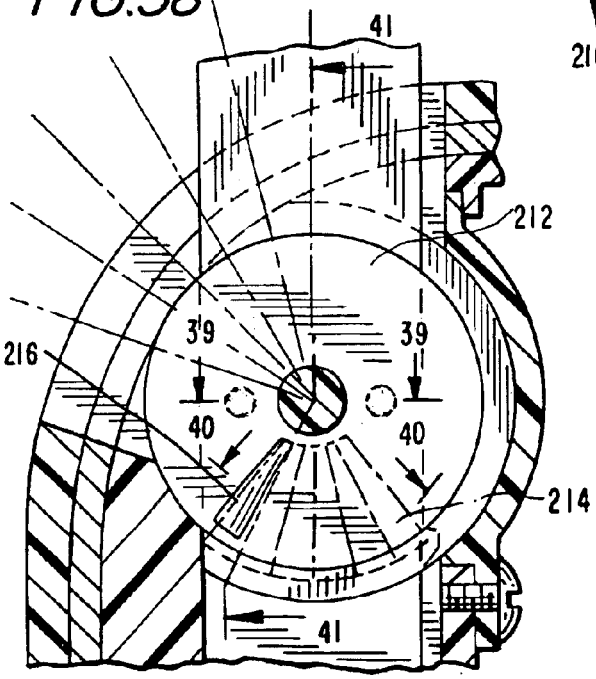
FIG. 38 is a partial detail on cross-section showing the assembly of FIG. 37 installed in a case with the handle in the extended position.
Figure 42:
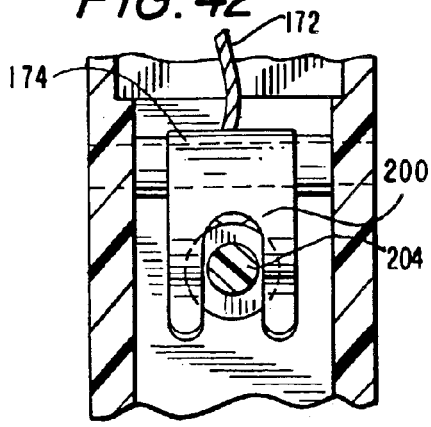
FIG. 42 is a cross-sectional detail taken along lines 42—42 of FIG. 41.
Figure 43:
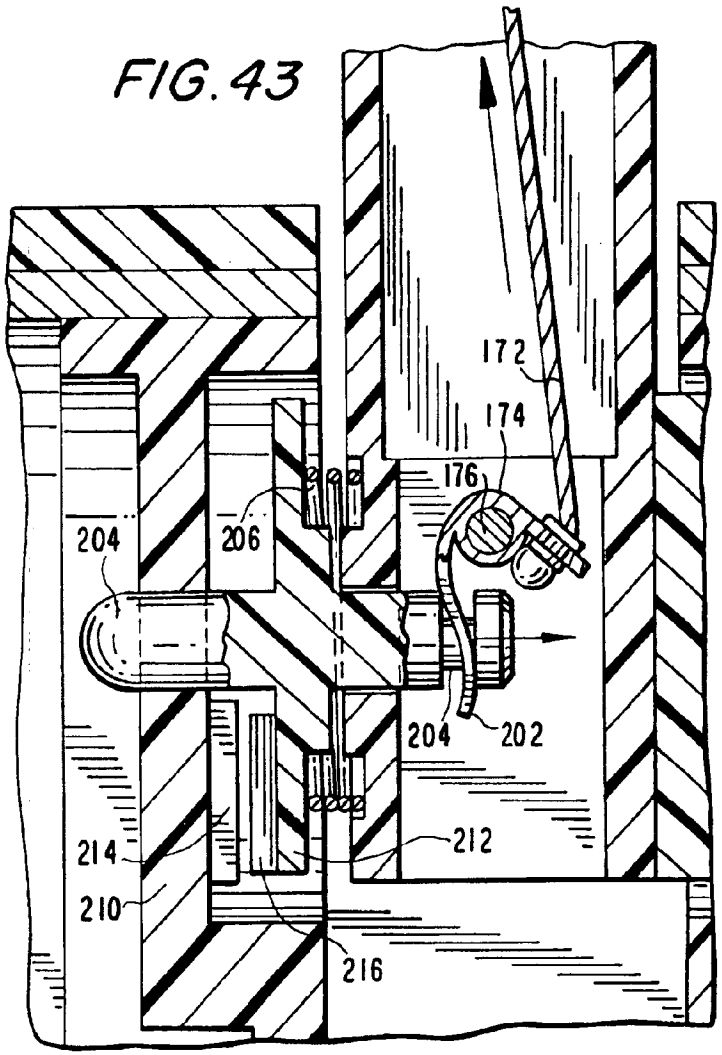
FIG. 43 is a cross-sectional view similar to FIG. 41 illustrating the activation of the release mechanism of handle-positioning assembly of FIG. 31.

Several other aspects and preferred embodiments of the invention will be described with reference to FIGS. 16–22, where there is shown an adjustable positioning plate assembly 70 that includes mounting plate 72 having a pair of handle apertures 74 and a plurality of vertically aligned position apertures 76 and guide pin mounting apertures 78. Slide plate 80 is mounted for sliding engagement with mounting plate 72 by means of a pair of guide pins 79 that are received in guide channels 81. An engagement member 86 projects inwardly to face mounting plate 72 and is adapted to be received in one of the plurality of positioning apertures 76. The engagement member 86 extends from a flexible portion of the slide plate formed by a pair of vertical grooves 88 extending from the lower edge adjacent the release handle 82. In operation, handle 82 is used to move engagement member 86 to the desired position aperture 76, as best shown in FIG. 22. It will also be noted from FIG. 17 that slide plate 80 is also provided with at least one pointer 90 that extends from a position on the face of the plate and corresponds to a plurality of unique indicia that are contained on the fixed mounting plate 72 for the purpose of indicating a corresponding engagement between member 86 and one of the position apertures 76.

A functioning of a further aspect of the invention will be made with reference to FIGS. 16, 19 and 20 in which there are shown a bubble gauge 94 mounted on the top exterior surface of the case and a swing gauge 96 with a pointer 98 that is mounted on the right side wall of the case. It will be understood that the center of gravity of the wheeled case will depend upon the weight and manner of the objects packed inside of the case. For example, if a heavy-end dense object was packed adjacent the rear wall towards the top of the case, the center of gravity will be in a different position than if the same object had been packed more towards the center or lower end of the case and towards the front wall.

In any event, the force or effort required to tow the wheeled case will be minimized if the center of gravity is maintained over the axis of the wheels or roller upon which the case is supported during towing. In the practice of the method relating to this aspect of the invention, the user tilts the case from the vertical to find the optimum balance position with the center of gravity over the wheels, i.e., no tendency of the case to fall forwards or backwards, and notes the position of the bubble or the swing gauge pointer 98 with respect to the indicia 92' that appear on the gauge. These indicia correspond to the same settings 92 on the mounting plate 72. This step of determining the preferred setting for the slide plate 80 is preferably performed before handle 4 is withdrawn from the case in order to provide the maximum stability. Once the slide plate has been moved to align pointer 90 with the previously determined indica to optimize the angle, the handle is withdrawn fully and the biasing force of the coil spring moves the handle into contact with upper edge 85 where it is maintained against customary towing forces. As in the previous embodiments, should the case fall on the side with the extended tilted handle, the impact force will move the handle against the force of the coil spring bias and the handle will rotate to a position more nearly parallel to the rear wall. Once the case is moved from this position, the handle will resume the desired tilted impact position with respect to the rear wall of the case.

A further embodiment of the invention will be described with reference to FIGS. 23–28 in which a retaining plate 110 is secured to top wall 6 of the case and slide plate 112 is mounted similarly to that of the previously-described embodiment. When the handle 4 is withdrawn from the guide means, a biasing coil spring applies a force tending to move the handle in the vertical direction against the leading edge 114 of slide plate 112. The handle 118 is used to lift a flexible portion of slide plate 112 that includes engagement member 119 to seat in one of a plurality of detents 122 in the lower receiver plate 120. A leaf spring 116 or other biasing member urges slide plate 112 into contact with handle 4. In the event that the case inadvertently falls on the tilted handle, the slide plate and receiving plate are pushed back by the handle against the force of the leaf spring. Again, once the bag is lifted, the slide plate moves into its previously determined position.

A further embodiment of the invention will be described with reference to FIGS. 29–32 where there is shown a mounting assembly similar to that described above. Mounting plate 140 is provided with a central channel 42 containing pairs of spaced notches 144. A slide plate 150 is provided with retaining means 152 for securing the end of a release arm 149 which forms a part of locking member 146 that also includes locking arm 148 adapted to engage the opposing notches 144. In this embodiment, the extended handle is subject to the rotational forces of a biasing spring which force the handle into contact with the upper edge 154 of slide plate 150. In this embodiment, it will be understood that in the event of a excessive impact force against the grip 14 of handle 4, the handle will move against the countering rotational force of the coil spring and there will be no movement required in the adjustable positioning assembly.

One preferred embodiment of an adjustable handle-positioning assembly for use in the invention is depicted in FIGS. 33–36 where pivot arm 170 is mounted on handle grip 13 and connected by actuator cable 172 to crank one arm of crank 174 mounted for pivoting on pivot pin 176. The other arm of crank 174 contacts the side of the moveable plate 190 opposite a plurality of ejector pins 192 which are aligned to engage corresponding position apertures 184 in disk 180 that is mounted for rotation on axle 182. In operation, a single spring biased positioning pin 194 is located to enter and be retained in one of the position apertures 814, thereby providing a positive fixed position to the extended tilted handle. In order to disengage the positioning pin 194, the pivot arm 170 is lifted moving the ejector pins into the apertures and permitting free rotation of the handle.

Figure 41:
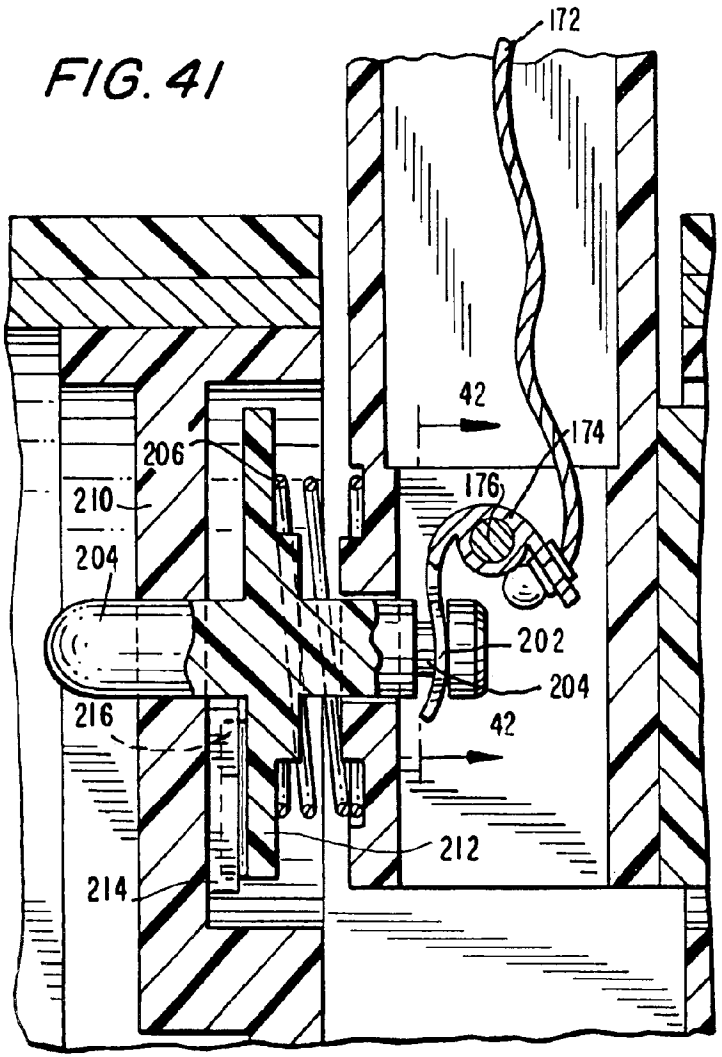
FIG. 41 is a cross-sectional view taken along lines 41—41 of FIG. 38.

A further embodiment of a release mechanism is illustrated in FIGS. 37–43 where a pivot arm 170 is mounted for rotational movement on handle grip 14 and joined by actuator cable 172 to one arm of a pivotally mounted crank 174. The opposite arm 200 is a bifurcated member that engages a receiving groove in axle 204 that forms part of a spring biased ratcheting clutch assembly formed by first disk clutch 210 and second disk clutch 212, the opposing surfaces of which are respectively formed with a plurality of radial grooves and a corresponding radially extending haul member adapted to engage one of the grooves. AS shown in FIG. 41 spring 206 urges the clutch wheels 210 and 212 into engagement but the application of excessive force to the handle will permit the angular radial pawl to rotate and move across the radial ratchet grooves without damaging the extended handle. In order to adjust the handle, an upward force applied to actuator cable 172 compresses the spring 206 thereby allowing the radial pawl to be disengaged and the extended handle to be freely rotated to that desired position, whereupon the release of the actuator cable permits the coil spring 206 to urge the clutch wheels once again into engagement.

A further embodiment of the positioning and release assembly is illustrated in FIGS. 44–47 where a spring-biased ball catch 230 is mounted in a position adjacent the handle apertures in mounting plate 32 for engagement with a corresponding detent in the extended handle when it is moved into a tilted position. As will be understood by one of ordinary skill in the art, the single ball catch can be replaced by a plurality of these devices and the handle provided with two, or even more, detents in order to increase the force required to displace the handle. In an alternative configuration, the ball catches can be placed in the handle and the mounting plate provided with a plurality of detents corresponding to a predetermined number of adjustable positions for the handle. Ball catches can be placed to engage the handle on both sides of the mounting plate at each aperture. In this embodiment, no coil spring or other biasing device need be secured to the handle to cause its rotation; the user can manually adjust the handle and any excessive force applied to the handle should the case fall over will simply dislodge the ball catches from the detents and permit the handle to rotate to a position where the force is reduced. In this embodiment the user will then have to reset the handle to the desired or predetermined indicated angle.

Figure 44:
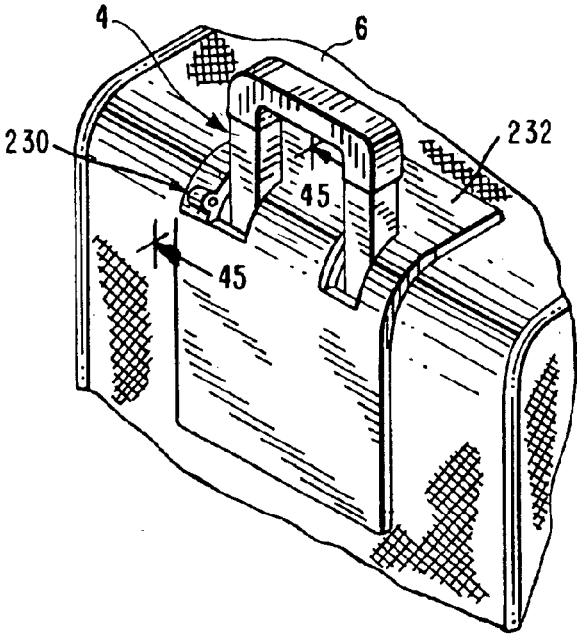
FIG. 44 is a partial top rear perspective view of a wheeled case illustrating another embodiment of the invention.
Figure 45:
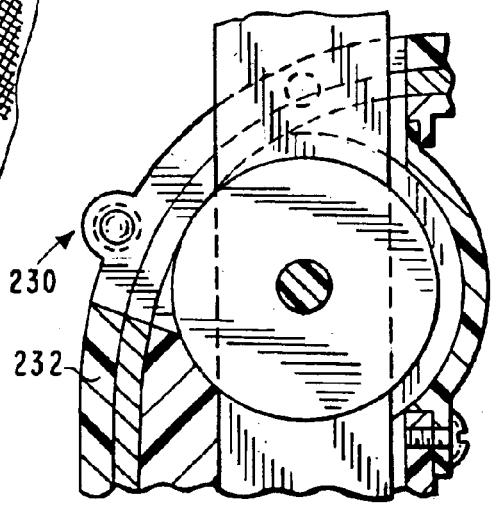
FIG. 45 is an enlarged cross-sectional view taken along lines 45—45 of FIG. 44 with the handle extended and parallel to the wall.
Figure 46:
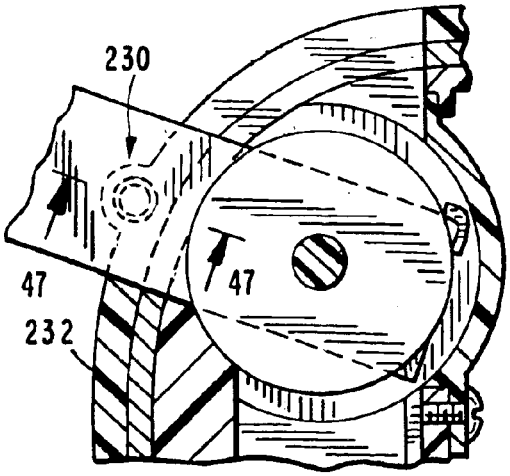
FIG. 46 is a cross-sectional view similar to FIG. 45 with the handle moved to a first tilted position with respect to the wall.
Figure 47:
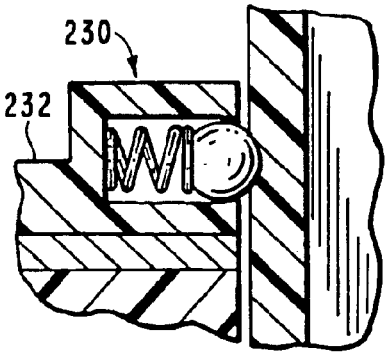
FIG. 47 is a detailed cross-sectional view taken along lines 47—47 of FIG. 46.

As will be apparent from the above detailed description and the drawings the embodiment of FIG. 44 can also be positioned with the retaining plate extending across the top wall 6 of the case so that the handle 4 is stored in the horizontal position and is withdrawn in the horizontal direction from the rear of the case. A telescoping handle can be utilized to provide the required length.

It will be readily appreciated that all of these embodiments share the characteristic of a breakage-resistant handle. In a situation where the handle is at an inclined angle and the case and the handle fall such that the outermost end of the handle contacts the ground first, the danger of breakage or bending of the handle will be minimized, despite the lack of any deliberate sectioning of the handle as described in my U.S. Pat. No. 6,129,365. This is so simply because the force of any such fall will be transmitted through the handle so as to push the push pin back into a position where the spring biasing the push pin is compressed, thus allowing the handle to assume a position parallel to the rear wall of the case and avoid breakage or bending of the handle. In these embodiments, there should be no spring-biasing of the rotating discs. Such spring-biasing would have the effect of increasing the resistance of the handle to rotation back to the vertical over such resistance where only the push pin and holes or notches are present.

It will also be understood that multiple angular positions are not only possible with a telescoping arm as shown in the third embodiment, but can easily be provided in the second embodiment by merely adding an additional notch at the appropriate position for each additional angle of operation desired.

Furthermore, it should be understood that the first embodiment of the invention showing a means for guiding and supporting the handle extending only part way down the case wall is by no means a requirement, and such means for guiding and supporting the handle can extend completely down the height of the case, i.e., the entire length of the wall adjacent to which it is positioned, thereby perhaps eliminating the need for a telescoping handle for handles of greater length.

Furthermore, it should be noted that, in general, inclined handles such as the one here disclosed, and in my previously mentioned United States patents, have the advantage of keeping the case further from the body of the user, a given position of the hand of the user in towing the case, than would be the situation if the handle extended parallel to the rear wall of the case. This will have the beneficial result of preventing the case from colliding with the user's heel when the case is towed behind the user, which can frequently happen with a conventional handle parallel to the rear wall of the case. In addition, such inclined handle cases, in general, require a user to exert less force on the handle to keep the case at a particular angle of tilt, when compared to a case in which the extended handle is parallel to the rear wall.

The location of the majority of the handle in the interior of the case when in the retracted storage position is not to be viewed as a necessary feature, since the guide means and the handle can be mounted on the exterior wall of the case. Furthermore, the preferred embodiments illustrate the inclined handle mounted on the rear wall of the case, thereby allowing movement in the two co-linear directions parallel to the side walls 16 of the case. It should be understood that an inclined handle can be mounted on either side wall 16 of the case, or on the top of the case, projecting in any direction, thereby allowing the case to be wheeled in either of the two collinear directions parallel to the front wall 18 and rear wall 3 of the case, provided that sufficient and properly placed wheels are present on the case.

Figure 48:
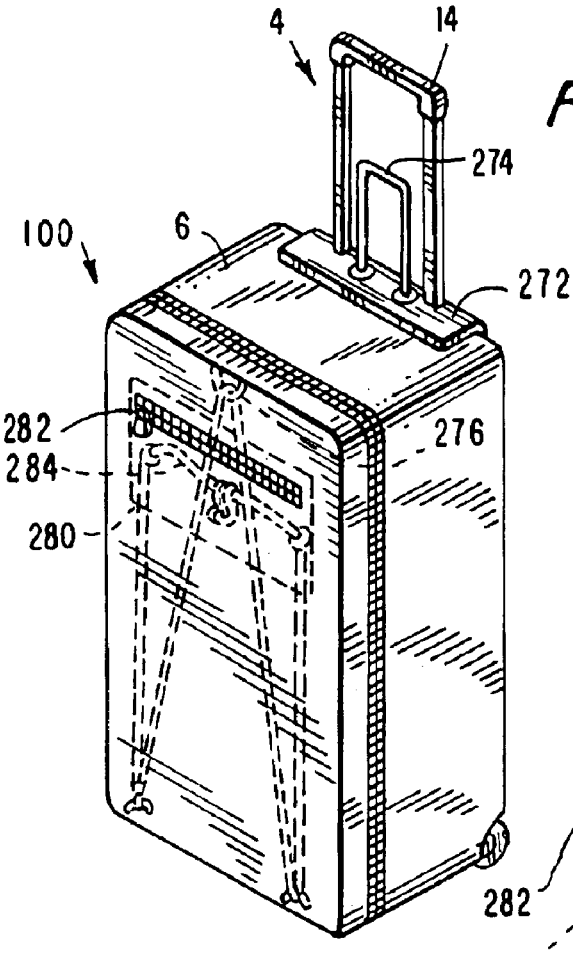
FIG. 48 is a top front perspective view of a wheeled case, illustrating another embodiment of the invention.
Figure 49:
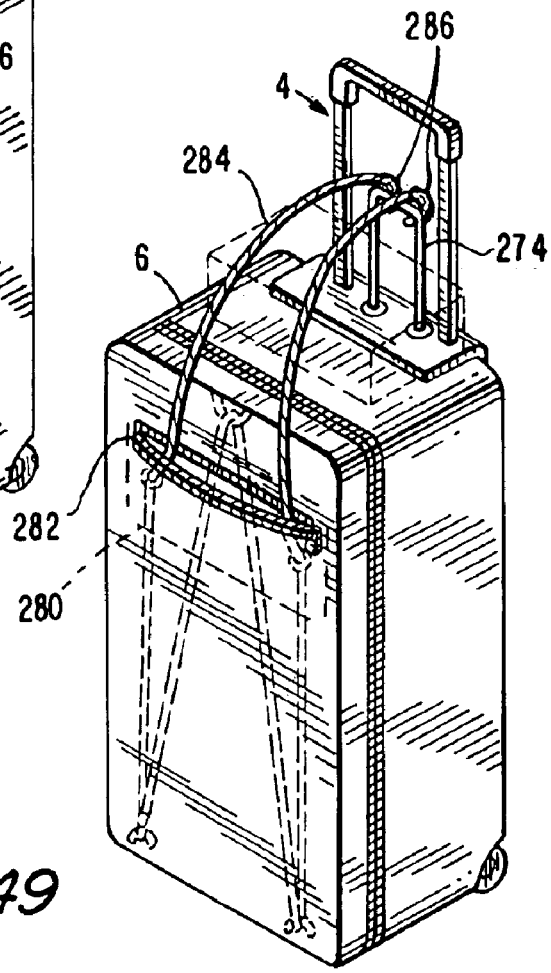
FIG. 49 is a view similar to FIG. 48 illustrating the use of extendable retaining means.

FIGS. 48 and 49 illustrate a further embodiment of the invention in which the mounting plate 272 includes a retractable supplemental baggage retainer 274 which is illustrated in the form of a unshaped member that is extendable from its stored position to that shown in FIG. 48. The purpose of baggage retainer 274 is to provide a support for additional bags or cases that are placed upon the top wall 6 of the wheeled case 100. The configuration and position of retainer 274 accommodates the handle of a computer case, briefcase or other small business or personal carrying case to thereby relieve the user of the weight of carrying such other cases in a free hand or over a shoulder while towing the case 100. As will be understood, the retainer 274 is necessary to prevent the additional case(s) from sliding off the tope of case 100 when it is tilted for movement.

In the further preferred embodiment illustrated in FIGS. 48 and 49, wheeled case 100 is also provided with a pocket 280 on the front wall opposite the retainer 274, the pocket preferably being closed by a zipper 282 and containing the free end of an elasticized cord such as a shock cord that is stored in the pocket when not in use. The details of fitting a case with an external pocket such as 280 and securing the auxiliary securement strap 284 such as that illustrated in FIGS. 48 and 49 is fully described in U.S. Pat. No. 5,927,450, the disclosure of which is hereby incorporated by reference. As shown in FIG. 49, when the free ends of the strap 284 are withdrawn from pocket 280 they can be hooked across any cases and the like that are placed on top of wheeled case 100 to maintain them in position during transit. Strap 284 is provided with clips or hook-type fasteners to engage baggage retainer 274. As noted, if elastic straps are used, the length of the free ends of strap 284 are predetermined to provide sufficient tension to retain additional stowed cases in position on the top wall. The configuration of baggage retainer 274 can be modified without departing from the spirit and scope of the invention. For example, instead of being a generally u-shaped tubular member, the retainer can be in the form of a generally plainer molded plastic member provided with a lifting aperture, one or more grooves to receive the securing strap and other apertures to facilitate the attachment of straps, cords and the like. The retainer can also be provided with extendable arms that can be collapsed or telescoped in order to receive the smaller handle of a briefcase or other carrying case and then expanded and even provided with a lock so that once the handle of the case is placed over the upper portion of the retainer and moved down the vertical section (s), the crossarm can be expanded and locked to prevent the easy removal of the case from its position on the retainer. This feature obviously provides a significant measure of security for the user who may be moving through crowded streets or transportation centers and who may be concerned about the theft of valuable computer in a carrying case placed on top of wheeled case 100.

As will be understood by one familiar with the art, the handle can also be of a T-configuration with the cross-arm of the T constituting the grips. The handle can also be of an L configuration in which the short base of the L constitutes the grip.

I claim:

1. A towable wheeled luggage case having an extendable handle assembly rotatable about a pivot axis within a limited angular range to minimize the downward vertical force on the handle assembly experienced by users of different heights when the wheeled luggage is tilted for towing, said wheeled luggage case having a generally rectilinear bottom wall and top wall and four elongated side walls extending between the top and bottom walls;

said handle assembly extendable from a position proximate the top wall;

the bottom wall being provided with at least one pair of supporting wheels mounted proximate the bottom wall and positioned adjacent a rear side wall in the direction from which the extendable handle projects;

the extendable handle assembly comprising at least one rigid leg joined at one end to a transverse hand grip, the at least one leg being movable between a first retracted storage position inside the case and a second extended position projecting from the case, the hand grip being maintained on the exterior of the case proximate the intersection of the top wall and rear side wall in the first position;

the handle assembly being angularly adjustable in the second extended position to intersect the rear wall at an angle that is different than the angle formed with the rear wall when the handle assembly is in the first storage position, the axis of rotation of the handle assembly being proximate to the intersection of the top wall and rear wall of the case;

angular retaining means secured to the case and in contact with the handle assembly to releasably secure the at least one extended leg in at least one fixed angular position with respect to the plane of the rear wall of the case the angular displacement being in the range of 15° to 38° from the vertical to thereby to minimize the effective downward vertical force on the hand grip during towing when the extended handle is in the operable towing position; and release means cooperatively engaged with the retaining means and responsive a predetermined external impact force applied to the handle assembly in the direction perpendicular to the plane of the rear wall, whereby actuation of the release means allows the handle to move in response to the predetermined impact force to a position which is generally parallel to the surface of the rear wall of the case.

2. The case of claim 1 in which the at least one leg of the handle in the first retracted position is parallel to the rear side wall.

3. The case of claim 1 in which the at least one leg of the handle in the first retracted position is parallel to the top wall.

4. The case of claim 1, wherein the handle assembly in the second extended position is movable between a plurality of angular positions with respect to the rear side wall.

5. The case of claim 4, wherein the handle assembly is movable to a predetermined number of positions whose angular relation to the rear side wall are fixed.

6. The case of claim 5, wherein each of the predetermined positions is associated with one of at least two unique position indicators.

7. The case of claim 6, wherein the position indicator is selected from the group consisting of letters, numbers and alphanumeric characters.

8. The case of claim 7, which further comprises at least one position gauge that is responsive to the angular displacement of the rear side wall of the case from vertical.

9. The case of claim 7, wherein the position gauge is selected from the group consisting of bubble gauges and pendulum gauges.

10. The case of claim 9, wherein the position gauge is a bubble gauge and the bubble gauge is secured to the top wall or a side wall adjoining the rear side wall.

11. The case of claim 8, wherein the position gauge includes a number of indicators corresponding to the at least two unique position indicators proximate the at least one handle leg.

12. The case of the claim 5, wherein the handle assembly is movable to a first fixed position that is displaced from about 15° to about 20° from the vertical, and to a second fixed position that is displaced from about 32° to about 38° from the vertical.

13. The case of claim 12, wherein the first position is displaced about 17° from the vertical and the second position is displaced about 35° from the vertical.

14. The case of claim 5, wherein at least one fixed position is within the range of 15° to 20° from the vertical.

15. The case of claim 5, wherein at least one fixed position is within the range of 32° to 38° from the vertical.

16. The case of claim 5, wherein the handle is moveable to one fixed position that is in the range of 15° to 20° and to a second fixed position in the range of 32° to 38° from the vertical.

17. The case of claim 16 in which one position is 17° and the second position is 35°.

18. The case of claim 1, wherein the handle grip comprises movable release means for cooperatively engaging the angular retaining means, whereby the activation of the release means facilitates the change of angular position of the at least one handle leg.

19. The case of claim 1, wherein the release means comprise biasing spring means in contact with a slidable plate that forms a part of the retaining member, the biasing force of the spring means extending in a direction normal to the rear side wall of the case.

20. The case of claim 1, wherein the angular retaining member is adjustable.

21. The case of claim 20, wherein the adjustable retaining member comprises a circular ratchet assembly that engages proximal ends of the arms whereby the arms are movable between a plurality of fixed angular positions.

22. The case of claim 20, wherein the angular retaining member is a spring-biased clutch assembly that engages proximal ends of the legs of the handle assembly, the clutch having a pre-determined range of angular rotation, whereby the at lease one leg is movable between an infinite number of angular positions within the predetermined range.

23. The case of claim 20, wherein the adjustable retaining member comprises a manually actuated movable slide plate, the slide plate provided with an engagement member, and a receiving plate provided with a plurality of stops for cooperatively receiving the engagement member of the slide plate in a selected position, whereby the angular position of the at least one leg is determined by the position of the slide plate relative to the fixed receiving plate.

* * * * *